US006600097B2

(12) United States Patent
Shiiya

(10) Patent No.: US 6,600,097 B2
(45) Date of Patent: Jul. 29, 2003

(54) DATA SYNCHRONIZER FOR SUPPLYING MUSIC DATA CODED SYNCHRONOUSLY WITH MUSIC DAT CODES DIFFERENTLY DEFINED THEREFROM, METHOD USED THEREIN AND ENSEMBLE SYSTEM USING THE SAME

(75) Inventor: Yoshihiro Shiiya, Shizuoka (JP)

(73) Assignee: Yamaha Corporation, Hamamatsu (JP)

( * ) Notice: Subject to any disclaimer, the term of this patent is extended or adjusted under 35 U.S.C. 154(b) by 15 days.

(21) Appl. No.: 10/043,828

(22) Filed: Jan. 11, 2002

(65) Prior Publication Data

US 2002/0092411 A1 Jul. 18, 2002

(30) Foreign Application Priority Data

Jan. 18, 2001 (JP) ..... 2001-010620

(51) Int. Cl.[7] ..... A63H 5/00; G04B 13/00
(52) U.S. Cl. ..... 84/609; 84/645
(58) Field of Search ..... 84/600, 609, 645, 84/649

(56) References Cited

U.S. PATENT DOCUMENTS 6,281,424 B1 * 8/2001 Koike et al. ..... 84/636
6,380,473 B2 * 4/2002 Uehara ..... 84/609
6,489,549 B2 * 12/2002 Schmitz et al. ..... 84/609

FOREIGN PATENT DOCUMENTS

JP 05-297867 11/1993

* cited by examiner

*Primary Examiner*—Jeffrey Donels
(74) *Attorney, Agent, or Firm*—Morrison & Foerster LLP

(57) ABSTRACT

A set of MIDI data codes defines time intervals each between two events successively to occur, and lapses of time from initiation of playback are stored in a set of audio data codes read out from a music compact disc, wherein a data synchronizer converts times at which the events to occur to lapses of time from the initiation of playback so as to transfer the MIDI data codes to a musical instrument synchronously with the playback through a compact disc player, thereby playing a piece of music in ensemble between the musical instrument and the compact disc player.

31 Claims, 13 Drawing Sheets

T1

| NUMBER ASSIGNED TO MOVE-MENT (TNO) | INDEX (X) | MIN. | SEC. | FRAME NO. (FRAME) | 0 | MIN. | SEC. | FRAME NO. (AFRAME) |
|---|---|---|---|---|---|---|---|---|
| | | LAPSE OF TIME | | | | ABSOLUTE TIME | | |

Fig. 3 A

T2

| NUMBER ASSIGNED TO MOVE-MENT (TNO) | POINT | MIN. | SEC. | FRAME NO. (FRAME) | 0 | MIN. | SEC. | FRAME NO. (AFRAME) |
|---|---|---|---|---|---|---|---|---|
| | | LAPSE OF TIME | | | | ABSOLUTE TIME | | |

Fig. 3 B

T4

| IDENTIFIER i | LAPSE OF TIME | | |
|---|---|---|---|
| | MIN. | SEC. | FRAME |
| 1 | 00 | 00 | 00 |
| 2 | 00 | 02 | 37 |
| 3 | 00 | 05 | 00 |

F 1 F 2 F 3

Fig. 5

DATA SYNCHRONIZER FOR SUPPLYING MUSIC DATA CODED SYNCHRONOUSLY WITH MUSIC DAT CODES DIFFERENTLY DEFINED THEREFROM, METHOD USED THEREIN AND ENSEMBLE SYSTEM USING THE SAME

FIELD OF THE INVENTION

This invention relates to a data synchronizer for music data codes and, more particularly, to a data synchronizer for synchronously distributing music data codes different in format from other music data codes, a method used therein and an ensemble system using the same.

DESCRIPTION OF THE RELATED ART

Various kinds of information storage medium are used for storing music data information representative of pieces of music. However, the pieces of music data information are not stored in data codes formatted in a sole format. When a compact disk is designed to reproduce a piece of music through a compact disc player, pieces of music data information to be stored in a compact disc are stored in data codes, which is formatted in a certain format. The certain format is hereinbelow referred to as "audio data format". Accordingly, the data codes in the audio data format are referred to as "audio data codes". On the other hand, when a compact disc is designed to reproduce a piece of music through an electronic keyboard, the pieces of music data information are, by way of example, stored in data codes formatted in accordance with the MIDI (Musical Instrument Digital Interface) standards. The format defined in the MIDI standards is hereinbelow referred to as "MIDI format", and the data codes in the MIDI format are referred to as "MIDI data codes".

The MIDI data codes are not always processed through the electronic keyboard for reproducing a piece of music. The piece of music may be reproduced through an automatic player piano. The automatic player piano is a kind of composite keyboard musical instrument between an acoustic piano and an electronic player system. The electronic player system comprises an array of solenoid-operated key actuators and a controller. The array of solenoid-operated key actuators is provided under the keyboard, and the solenoid-operated key actuators are selectively energized by the controller. The controller is assumed to energize a solenoid-operated key actuator. The solenoid-operated key actuator upwardly pushes the rear portion of the associated black/white key, and gives rise to rotation of the associated black/white key without any fingering. The black/white key actuates the associated action, and the action escapes from the associated hammer. The hammer starts free rotation at the escape, and strikes the associated strings. Thus, the automatic player system plays a tune on the acoustic piano without any fingering of human pianist. A set of MIDI data codes is loaded into the controller before initiation of the performance. The controller determines what keys are to be actuated and when the key motion is to be initiated, and selectively energizes the solenoid-operated key actuators for moving the keys.

A set of MIDI data codes may be loaded into a keyboard for practical use. The keyboard for practical use has an array of light emitting elements on the black/white keys, and a controller notifies black/white keys to be depressed to a trainee by radiating light from the associated light emitting elements immediately before the time to depress the black/white keys. The controller also determines what keys are to be depressed and when the key motion is to be initiated on the basis of the set of MIDI data codes. Thus, a set of MIDI data codes is available for purposes relevant to the performance.

The MIDI data codes are distributed to plural musical instruments through the channels respectively assigned to the musical instruments. This means that a set of MIDI data codes is available for an ensemble among plural musical instruments. However, it is hard to achieve an ensemble between a musical instrument designed for the MIDI data codes and a sound reproducing apparatus such as the compact disc player. When a user reproduces a piece of music in ensemble between the musical instrument and the sound reproducing apparatus by all means, he or she needs to prepare a compact disc storing the MIDI data codes and another compact disc storing the audio data codes, and instructs the musical instrument and the sound reproducing apparatus concurrently to start the playback. However, the timing to start is to be given by the user. Such a manually achieved synchronization is complicated and incorrect.

A composite information storage medium has been proposed. Both of the audio data codes and the MIDI data codes are stored in the composite information storage medium. The set of audio data codes represents a piece of music, and the set of MIDI data codes also represents the piece of music. The ensemble is achieved by means of an exclusive data distributor. The exclusive data distributor synchronously reads out the audio data codes and the MIDI data codes, and distributes the audio data codes and the MIDI data codes to a sound reproducer and a musical instrument. With the audio data codes and the MIDI data codes synchronously distributed by the exclusive data distributor, an ensemble is achieved between the sound reproducer and the musical instrument such as the automatic player piano. The prior art ensemble system, i.e., the combination among the exclusive data distributor, the sound reproducer and the automatic player piano makes the quality of ensemble superior than the ensemble reproduced by the prior art sound reproducer, because the acoustic tones take a part of the ensemble.

A problem is encountered in the prior art ensemble system in that the composite information storage medium is required for the ensemble. However, most of compact discs commercially available in the music market only store the audio data codes. Although floppy discs storing the MIDI data codes are sold in the music market, it is rare to find a compact disc, which stores both of the audio data codes and the MIDI data codes for the prior art ensemble system.

SUMMARY OF THE INVENTION

It is therefore an important object of the present invention to provide a data synchronizer, which supplies music data codes different in format from other music data codes to a destination different from a destination of the other music data codes without a composite data source where both music data codes are stored.

It is another important object of the present invention to provide a method which is used in the data synchronizer.

It is also an important object of the present invention to provide an ensemble system, which distributes plural sorts of music data codes different in format and stored in plural data sources to appropriate destinations.

In accordance with one aspect of the present invention, there is provided a data synchronizer for transmitting a first sort of music data codes to a first sound source synchronously with a playback through a second sound source on the basis of a second sort of music data codes, and the data synchronizer comprises a memory storing the first sort of music data codes representative of pieces of music data information defining a plurality of first tones of a music passage to be produced and first pieces of timing data information defining first times to produce the first tones in accordance with a first rule and at least second pieces of timing data information stored in the second sort of music data codes and defining second times to produce a plurality of second tones of the music passage in accordance with a second rule different from the first rule, a mapping means having third times produced from the first times and defined in accordance with the second rule for mapping at least selected ones of the music data codes of the second sort to the certain music data codes of the first sort and a transmitting means for transferring the music data codes of the first sort to the first sound source in such a manner that the first tones corresponding to the certain music data codes are produced concurrently with the second tones corresponding to the at least selected ones.

In accordance with another aspect of the present invention, there is provided a method for transmitting music data codes of a first sort to a first sound source synchronously with a playback through a second sound source on the basis of music data codes of a second sort, and the method comprises the steps of a) acquiring the music data codes of the first sort representative of first pieces of music data information defining a plurality of first tones of a music passage and first pieces of timing data information defining first times to produce the first tones in accordance with a first rule and at least second pieces of timing data information stored in the music data codes of the second sort and defining second times to produce a plurality of second tones of the music passage in accordance with a second rule different from the first rule, b) converting the first times to third times defined in accordance with the second rule, c) instructing the second sound source to start the playback and d) transferring the music data codes of the first sort to the first sound source in such a manner that the first tones corresponding to the certain music data codes are produced concurrently with the second tones corresponding to the at least selected ones.

In accordance with yet another aspect of the present invention, there is provided an ensemble system comprising a first sound source for producing first tones of a music passage on the basis of a first sort of music data codes, a second sound source for producing second tones of the music passage on the basis of a second sort of music data codes, and a data synchronizer including a memory storing the first sort of music data codes representative of pieces of music data information defining a plurality of first tones of a music passage to be produced and first pieces of timing data information defining first times to produce the first tones in accordance with a first rule and at least second pieces of timing data information stored in the second sort of music data codes and defining second times to produce a plurality of second tones of the music passage in accordance with a second rule different from the first rule, a mapping means having third times produced from the first times and defined in accordance with the second rule for mapping at least selected ones of the music data codes of the second sort to the certain music data codes of the first sort and a transmitting means for transferring the music data codes of the first sort to the first sound source in such a manner that the first tones corresponding to the certain music data codes are produced concurrently with the second tones corresponding to the at least selected ones.

BRIEF DESCRIPTION OF THE DRAWINGS

The features and advantages of the data distributor, the method and the ensemble system will be more clearly understood from the following description taken in conjunction with the accompanying drawings in which:

FIGS. 3A and 3B are views showing formats of control data codes stored in the Q-channel of a sub-coding area in a music compact disc;

FIG. 5 is a view showing contents of a timing map table;

DESCRIPTION OF THE PREFERRED EMBODIMENTS

First Embodiment

Figure 1:
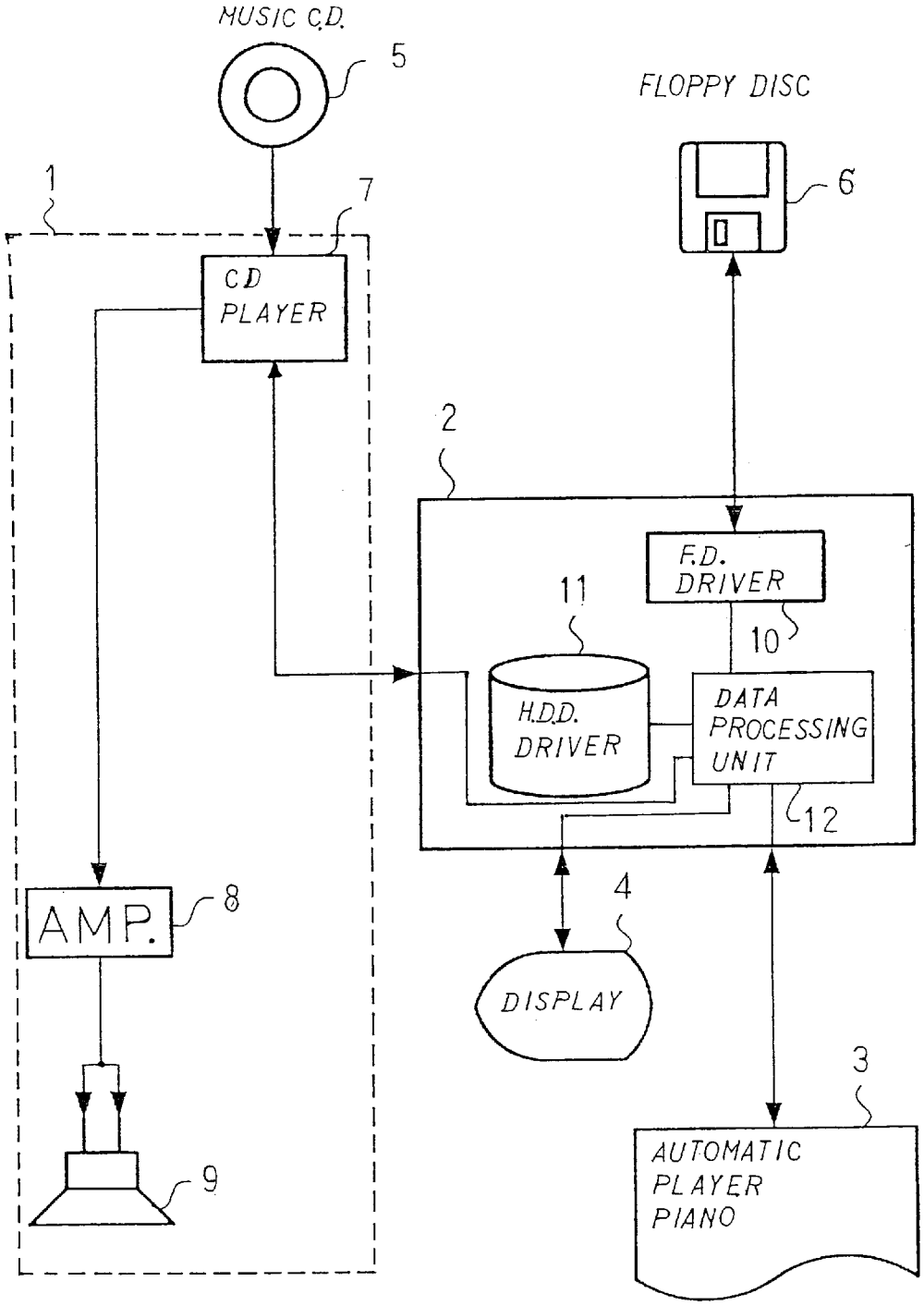
FIG. 1 is a block diagram showing the system configuration of an ensemble system according to the present invention.

Referring first to FIG. 1 of the drawings, an ensemble system embodying the present invention largely comprises a sound reproducer 1, a data synchronizer 2, an automatic player piano 3 and a monitor display 4. The ensemble system reads out two sorts of music data codes, i.e., audio data codes and MIDI data codes from two information storage media 5/6, and performs an ensemble. In this instance, one of the information storage media is a compact disc 5 in which plural sets of audio data codes are stored for pieces of music data codes. The audio data codes are formatted in accordance with the CD-DA (CD-Digital-Audio) standards. The other of the information storage media is a floppy disk in which sets of MIDI data codes are stored for the pieces of music.

The sound reproducer 1 includes a compact disc player 7, an amplifier 8 and a speaker system 9. The compact disc player 7 has an optical system, a suitable modulator, an error correction circuit and a digital-to-analog converter. A slot is formed in the case of the compact disk player, and the compact disc 5 is loaded into the optical system through the slot. The optical system reads out pieces of music data information from the compact disc 5, and reproduces an electric pulse train from the output from the reflection on the compact disc 5. The modulator reproduces the audio data codes from the electric pulse train, and the error correction circuit eliminates error bits from the audio data codes. The digital-to-analog converter produces an audio signal from the audio data codes, and supplies the audio signal to the amplifier 8. The amplifier 8 regulates the magnitude of the audio signal, and the speaker system converts the audio signal to tones.

The compact disc player 7 is communicable with the data synchronizer 2. In detail, when the data synchronizer 2 sends a data request signal to the compact disc player 7, the compact disc player 7 supplies a control data signal representative of a TOC (Table Of Contents) and data codes stored in a Q channel of the sub-coding area to the data synchronizer 2. The TOC and the data codes assigned the Q-channel are stored in the compact disc 5, and are read out from the compact disc 5 to the compact disc player 7. The TOC and the data codes assigned the Q-channel will be hereinafter described in detail.

The data synchronizer 2 includes a floppy disc driver 10, a hard disc driver 11 and a data processing unit 12. The data processing unit 12 has a suitable interface, and the floppy disc driver 10, the hard disc driver 11, the compact disc player 7, the monitor display 3 and the automatic player piano 3 are connected to the data interface of the data processing unit 12. A slot is formed in the floppy disc driver 10, and the floppy disc 6 is loaded into the floppy disc driver 10 through the slot. The floppy disc driver 10 reads out the MIDI data codes from the floppy disc 6, and writes pieces of data information into the floppy disc 6 under the control of the data processing unit 12. On the other hand, the hard disc driver 11 has a built-in hard disc, and an identification data table for music CDs is stored in the built-in hard disc. The MIDI data codes are transferred to the data processing unit 12. The data processing unit 12 analyzes the MIDI data codes, and adds pieces of identification data to the identification data table or modifies the pieces of identification data, if necessary. The identification table will be hereinafter described in detail.

Figure 2:
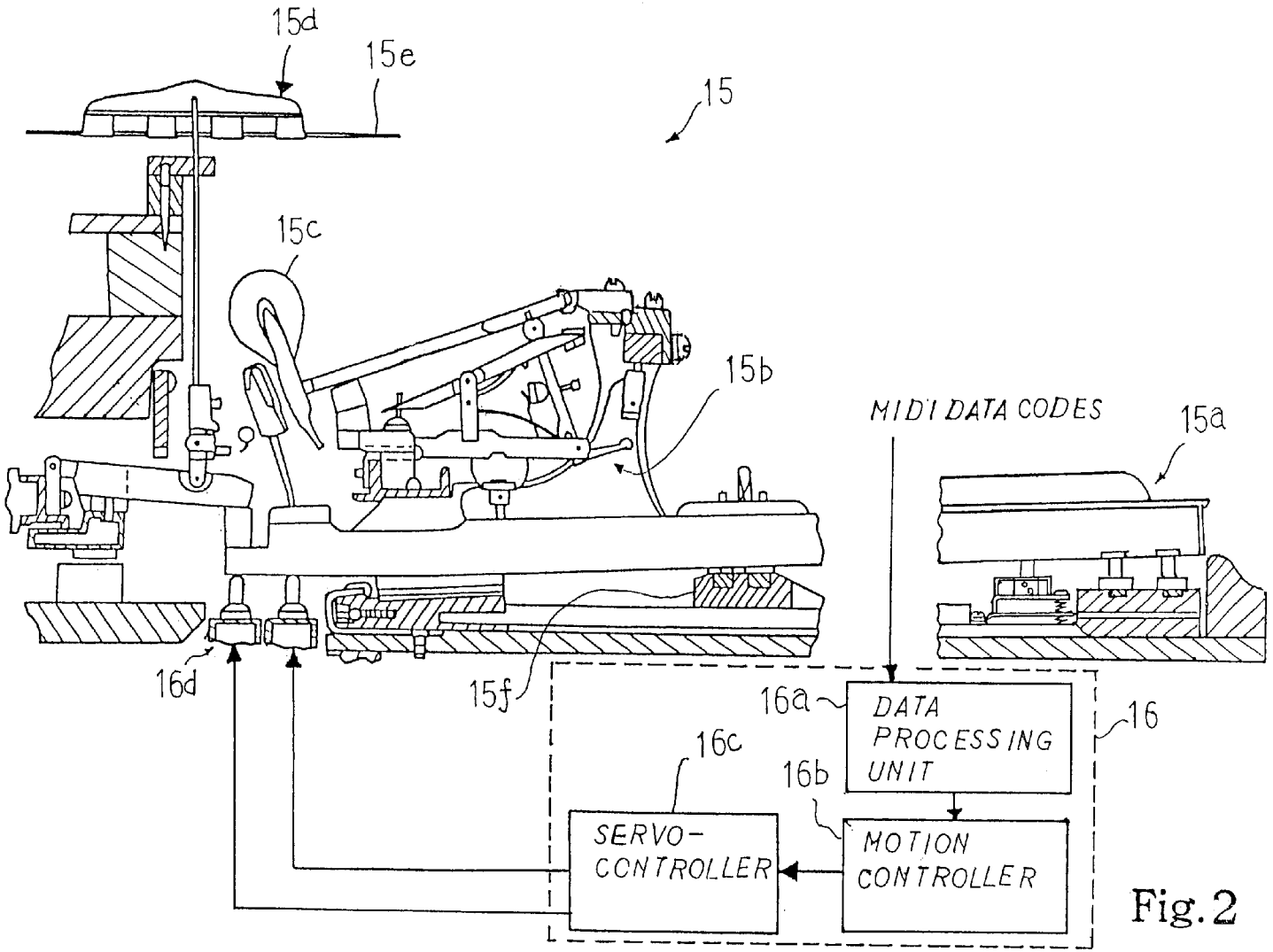
FIG. 2 is a schematic side view showing the structure of an automatic player piano incorporated in the ensemble system.

The automatic player piano 3 is illustrated in detail in FIG. 2. The automatic player piano is broken down into an acoustic piano 15 and an automatic playing system 16.

The acoustic piano 15 is a standard grand piano, and includes a keyboard 15*a,* an action 15*b,* hammers 15*c,* a damper mechanism 15*d* and sets of strings 15*e.* The keyboard 15*a* is mounted on a key bed, and black/white keys are laid on the well-known pattern. The black/white keys are rotatable about a balance rail 15*f,* and are linked with the action mechanism 15*b.* A pianist selectively depresses the front portions of the black/white keys, and the key motion is transferred to the action mechanism 15*b* and the damper mechanism 15*d.* The damper mechanism 15*d* spaces the dampers corresponding to the depressed keys from the associated sets of strings, and permits the strings to vibrate. The action mechanism 15*b* drives the hammers 15*c* corresponding to the depressed keys for free rotation, and the hammers 15*c* strike the associated strings 15*e.* The strings 15*e* vibrate for generating the tones. When the pianist releases the depressed keys, the depressed keys start to return to the rest position. The key motion is also transferred to the damper mechanism 15*d,* and the dampers are brought into contact with the vibrating strings so as to decay the tones.

The automatic playing system 16 includes a data processing unit 16*a,* a motion controller 16*b,* a servo-controller 16*c* and an array of solenoid-operated key actuators 16*d.* The data processing unit 16*a* is connected to the data processing unit 12, and the solenoid-operated key actuators 16*d* are mounted on the key bed under the rear portions of the black/white keys. The MIDI data codes are supplied form the data synchronizer 2 to the data processing unit 16*a,* and the data processing unit 16*a* analyzes the MIDI data codes to see what keys are to be moved, how fast the keys are to be moved and when the key motion is to be initiated. When the time to start the key motion comes, the data processing unit 16*a* instructs the motion controller 16*b* to determine a trajectory for the key. The motion controller 16*b* determines an initial key velocity and a lapse of time until each reference point on the way toward the rest position. The motion controller 16*b* supplies the pieces of control data information representative of the initial velocity and the lapses of time to the servo-controller 16*c.*

The solenoid-operated key actuators 16*d* have built-in sensors, respectively, and the built-in sensors supply feedback signals representative of the current plunger positions to the servo-controller. When the pieces of control data information arrive at the servo-controller 16*c,* the servo-controller determines the magnitude of a driving signal necessary to achieve the initial key velocity, and supplies the driving signal to the solenoid-operated key actuator associated with the key to be moved. The solenoid-operated key actuator 16*d* upwardly projects the plunger, and the plunger pushes the rear portion of the key. The built-in sensor varies the feedback signal, and the servo-controller 16*c* changes the magnitude of the driving signal, if necessary. Thus, the key is rotated without any fingering, and actuates the damper mechanism 15*d* and the action mechanism 15*b.* The damper is spaced from the associated string 15*e,* and the hammer 15*c* is driven for ration by the action mechanism 15*b.* The hammer 15*c* strikes the string 15*e,* and the string 15*e* vibrates for generating the tone.

In this instance, the compact disc 5 and the floppy disc 6 are plural data sources, and the sound reproducer 1 and the automatic player piano serve as sound sources to which the audio data codes and the MIDI data codes are selectively supplied. One of the data sources is a live performance supplied through a private/public communication system in the form of the audio data codes. Another data source is a silent piano. The silent piano is a combination of an acoustic piano, i.e., a grand piano or upright piano and an electronic tone generating system, and a pianist can play a piece of music in acoustic tones or electronic tones. In order to permit the pianist to play a piece of music in the electronic tones, the silent piano is equipped with a hammer stopper and an electronic sound generating system. The hammer stopper is provided in association with the hammers, and is changed between a free position and a blocking position. While the hammer stopper is maintained at the free position, the hammers strike the associated sets of strings without any interruption by the hammer stopper. When the hammer stopper is changed to the blocking position, the hammer stopper enters into the trajectories of the hammers, and the hammers rebound on the hammer stopper before striking the strings. The electronic sound generating system produces electronic sounds instead of the piano tones so that user can practice the fingering without disturbance to the neighborhood. The electronic sound generating system monitors the black/white keys through sensors to see what keys are depressed and how large the key velocity is. The key code and the key velocity are stored in the MIDI data codes together with the lapse of time from the initiation of the performance and other control data. The MIDI data codes are supplied through a communication cable to the data synchronizer for an ensemble. The hammer stopper and the electronic sound generating system, i.e., the silent system may be incorporated in the automatic player piano. The composite keyboard musical instrument, i.e., the automatic player piano equipped with the silent system may be connected to the data synchronizer 2 as either data or sound source.

Turning back to FIG. 1 of the drawings, the data processing unit 12 further includes a central processing unit, a program memory and a working memory. The program memory and the working memory may be implemented by a read only memory and a random access memory. The central processing unit sequentially fetches the instruction codes from the program memory, and executes jobs defined by the instruction codes so as to achieve synchronization between the sound reproducer 1 and the automatic player piano 3.

In order to achieve the synchronization between the sound reproducer 1 and the automatic player piano 3, the data synchronizer 2 requires several kinds of data information. One kind of data information to be required is representative of the titles of musical compositions stored in the compact disc 5. Another kind of data information is representative of what musical composition the user selects from the compact disc 5. Yet another kind of data information is the lapse of time from the initiation of the playback to the reproduction of each tone of the selected musical composition.

When an ensemble is requested, the data processing unit 12 specifies a set of MIDI data codes corresponding to the musical composition selected by the user, and creates a timing map table representative of the relation between the event data codes representative of note-on events and note-off events and times to transfer the MIDI data codes to the automatic player piano 3.

Identification of Compact Disc

A compact disc storing pieces of music is hereinbelow referred to as "music compact disc". A music compact disc has not only a storage area assigned to the audio data codes but also a free storage area called as "sub-coding area". Plural channels are incorporated in the sub-coding area, and are named P-channel, Q-channel, R-channel, S-channel, T-channel, U-channel, V-channel and W-channel. Pieces of control data information are stored in the P-channel and Q-channel. Data codes representative of the control data information are hereinbelow referred to as "control data codes". Although various applications have been proposed for the other channels, no further description is hereinbelow made on the applications.

The control data codes stored in the P-channel and the Q-channel are used for starting a selected musical composition at the first note and programmed reproduction. Although the control data codes in the P-channel roughly specifies the locations of the movements, the control data codes in the Q-channel are representative of detailed locations of the audio data codes. A format of the control data codes stored in the Q-channel is shown in FIG. 3A, and the detailed locations are labeled with T1. The control data codes in the Q-channel are used in the control over standard compact disc players. The format T1 has a section assigned to data bits representative of the frame number and the lapse of time MIN./SEC. from the head of the movement to the frame.

There is a read-in portion in the innermost lane of the music compact disc 5, and pieces of retrieval information are stored in the control data codes in the Q-channel formed in the read-in portion. The pieces of retrieval information are called as "Table of Contents". A format of the control data codes representative of the table of contents is shown in FIG. 3B. The format T2 has a section assigned to data bits representative of a time when the movement is to start. When a compact disc 5 is loaded into the compact disc player 7, the compact disc player 7 accesses the table of contents, and transfers the table of contents into the working memory. A user is assumed to request the compact disc player 7 to reproduce a movement, the compact disc player 7 accesses the working memory to fetch the data codes representative of the location of the audio data codes of the movement to be reproduced from the table of contents, and adjusts the pick-up to the first audio data code. The pick-up is a part of the optical system. The pick-up radiates a laser beam to the compact disk 5, and converts the reflection to the electric signal.

Figure 4:
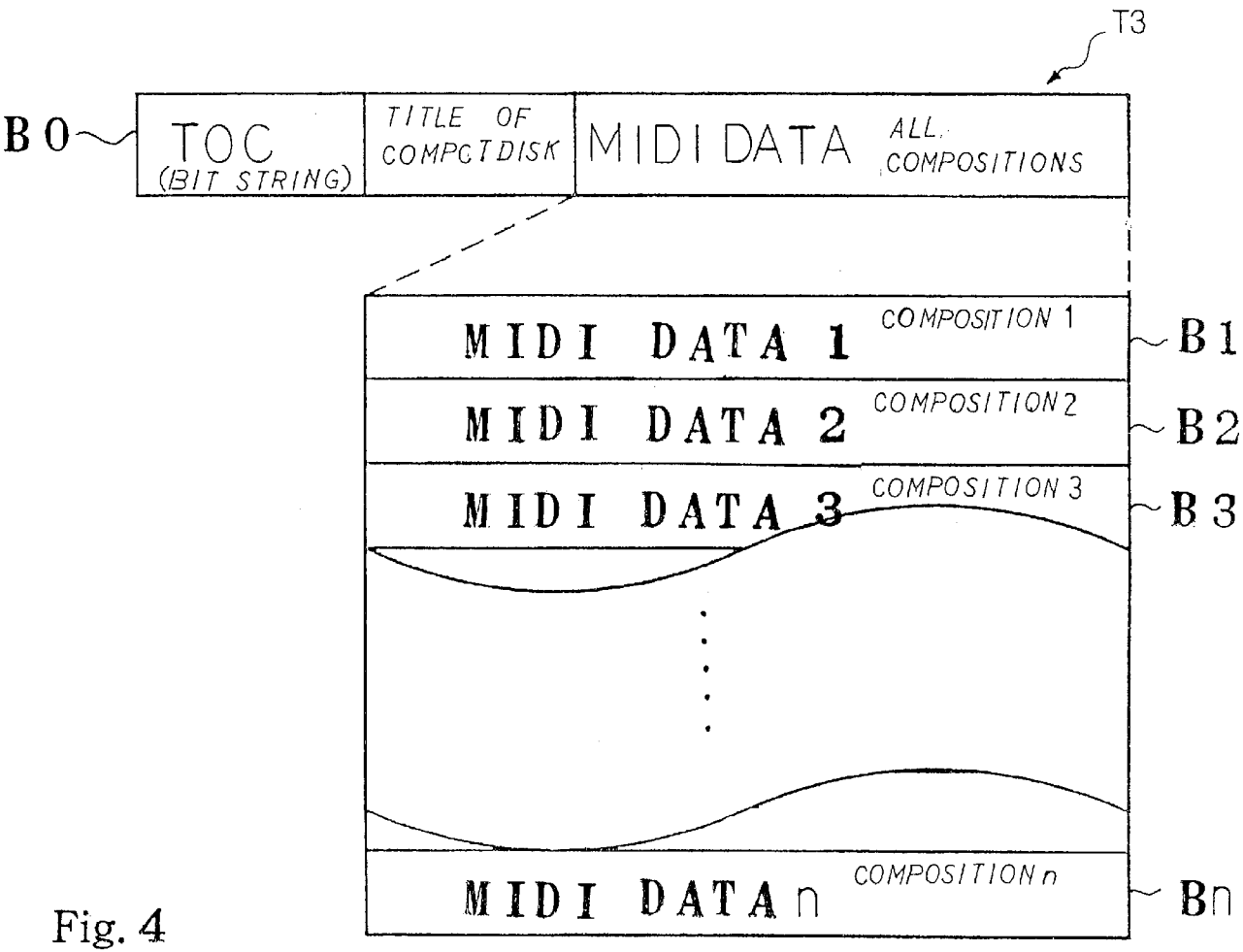
FIG. 4 is a view showing a file stored in a MIDI data table stored in a hard disc incorporated in a data synchronizer.

The control data codes stored in the table of contents have a bit string unique to the compact disk 5. A MIDI data table T3 is created in the hard disc 11 (see FIG. 4). The MIDI data table T3 includes plural files respectively assigned to compact discs sold in the market. Each of the files has a data block B0 and plural data blocks B1, B2, B3, . . . and Bn. The data block B0 is assigned to the bit string unique to the compact disc and data codes representative of the title of the compact disc. The data blocks B1, B2, B3, . . . and Bn are respectively assigned to sets of MIDI data codes representative of the compositions 1–n recorded in the compact disc.

When an ensemble is requested, the data processing unit 12 requests the compact disc player 7 to transfer the table of contents from the internal memory thereto. The table of contents reaches the data processing unit 12, and is stored in the working memory. The central processing unit checks the hard disc to see whether or not the bit string representative of the table of contents is same as any one of the bit strings TOC stored in the data blocks B0 in the MIDI data table T3. When the central processing unit finds the bit string TOC same as the bit string stored in the working memory, the central processing unit transfers the sets of MIDI data codes representative of all the compositions 1–n from the hard disc 11 to the working memory.

Creation of Timing Map Table

In order to synchronize the data transfer to the automatic player piano 3 with the playback through the sound reproducer 1, the data processing unit 12 creates a timing map table T4 (see FIG. 5). The timing map table includes plural data files corresponding to the data files of the MIDI data table T3. Thus, the data files in the timing map table T4 are respectively assigned to the musical compositions stored in the selected compact disc 5. Each of the data files has plural data blocks respectively assigned to the MIDI data codes representative of the events, i.e., note-on and note-off. Each of the data blocks has a data field F1 assigned to an identifier i, a data field F2 assigned to a lapse of time from the initiation of a musical composition and a data field F3 assigned to a frame number.

There are two timing controlling methods for MIDI sequencers. "Step time" is used for both timing controlling methods. One of the timing controlling methods is to adjust the time interval between adjacent two events to a piece of duration data information stored in the MIDI data code. The time interval is called as "delta time", and, accordingly, the timing control method is hereinbelow referred to as "delta time control". The other controlling method is to adjust time intervals from related bars each provided between the measures in a staff notation. In this instance, the timing map table is created on the assumption that the events are controlled by using the delta times in the sets of MIDI data codes.

When the compact disc is specified, the central processing unit 12 accesses the hard disc 11, and instructs the hard disc driver 11 sequentially to transfer sets of MIDI data codes representative of the musical compositions to the working memory. The data processing unit 12 repeats the following data processing sequence for completing the timing map table T4. The central processing unit sequentially searches the set for the MIDI data codes representative of one of the musical compositions for the events, and gives the identifier i to the MIDI data codes representative of the events. The identifier i is, by way of example, incremented by one, and the MIDI data codes representative of the events are numbered as 1, 2, 3, . . . . The event 1 is representative of the first note-on event in the selected piece of music, and event 2 follows it. The identifier i is registered in the data fields F1 of the plural data blocks, respectively.

Figure 6:
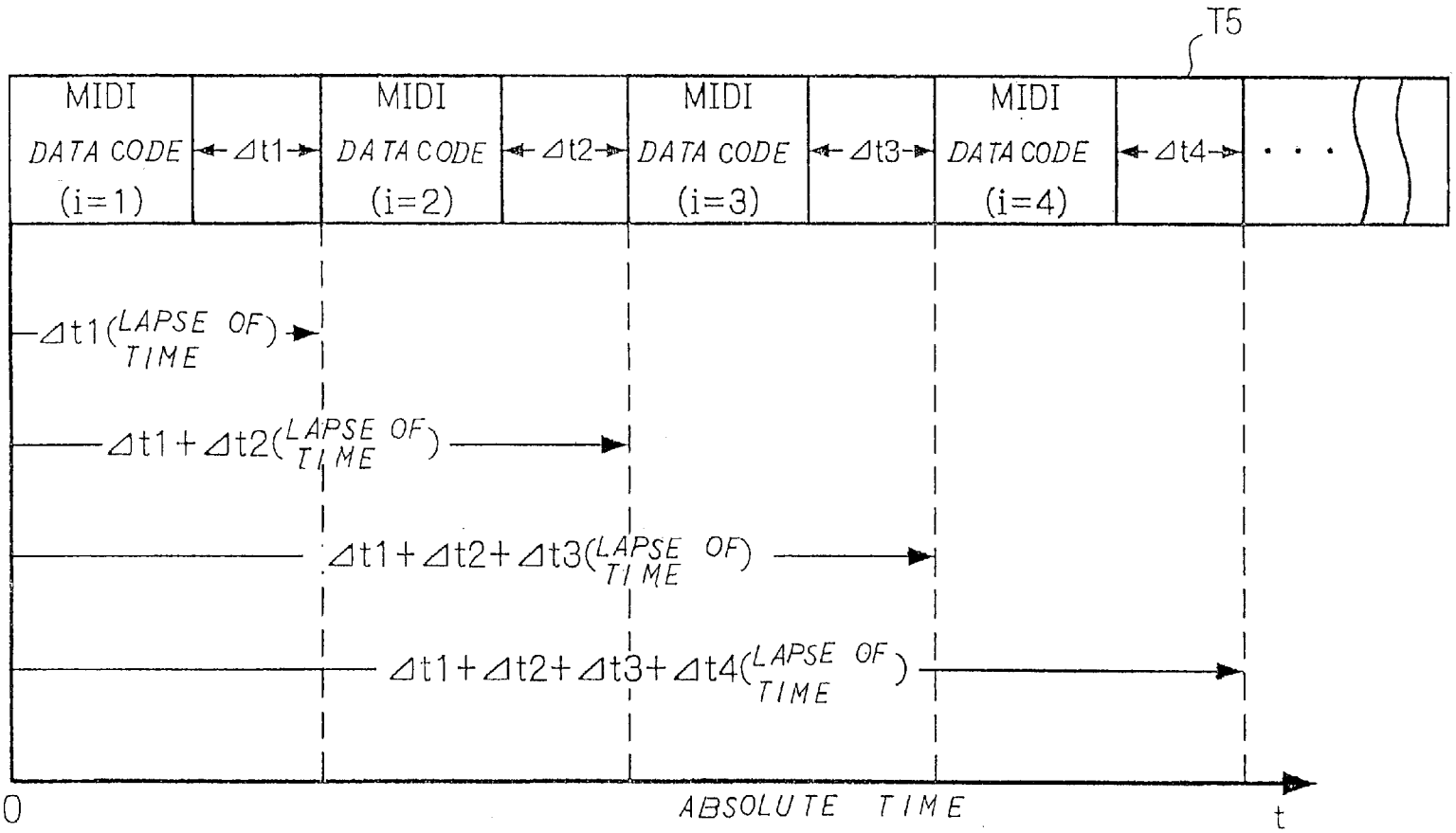
FIG. 6 is a view showing a conversion from step time data to a lapse of time from the initiation of playback to each event.

Subsequently, the central processing unit determines the lapse of time from the initiation of the playback for each of the events i. The tempo has been given to any piece of music data information, and is stored in the set of MIDI data codes. The lapse of time is calculated on the basis of the piece of control data information representative of the tempo and the frequency of clock signal. The central processing unit determines the lapse of time from the initiation of the playback to each event as shown in FIG. 6.

The delta time Δt1 is between the first event 1 and the next event 2, and the event 3 is spaced from the second event 2 by Δt2. The time interval between the third event 3 and the fourth event 4 is Δt3, and Δt4 is representative of the time interval between the fourth event 4 and the next. The first event 1 takes place at time 0, and "00" min. "00" sec. are written in the data field F2 of the first data block. The piece of music starts at the first event 1, and the lapse of time from the first event 1 to the second event 2 is Δt1=2 seconds. Then, the central processing unit determines the second event is to occur at 2 seconds from the initiation of the playback, and writes "00" min. "02" sec. in the data field F2 of the second data block. The time interval between the second event 2 and the third event is Δt2 so that the lapse of time from the initiation of the playback to the third event is equal to the sum of Δt1 and Δt2, i.e., Δt1+Δt2. The delta time Δt1 and the delta time Δt2 are 2 seconds and 3 seconds. The central processing unit determines that the third event is to occur at Δt1+Δt2, and writes "00" min. "05" sec. in the data field F2 of the third data block. Similarly, the lapse of time from the initiation of the playback to the fourth event 4 is equal to the sum of Δt1, Δt2 and Δt3, and the fifth event is to occur at Δt1+Δt2+Δt3+Δt4. Thus, the central processing unit determines the lapse of time from the initiation of playback to each event, and writes the pieces of time data each representative of the lapse of time in the data fields F2 of the data blocks in the timing map table T4.

Subsequently, the central processing unit accesses the corresponding set of audio data codes, and searches the field of the data the audio data codes assigned to the lapse of time to see what frame is to be reproduced concurrently with one of the events. When the central processing unit finds a frame equal to be reproduced concurrently with the event, the central processing unit writes the frame number in the data field F3 of the data block assigned to the event. The central processing unit repeats the search, and makes the events 1, 2, 3, corresponding to the frames of the associated set of audio data codes. Thus, the central processing unit fills the data fields F3 with the frame numbers. If the central processing unit finds more than one frame, the central processing unit assigned the frame with the least frame number to the event.

Behavior in Ensemble

Figure 7:
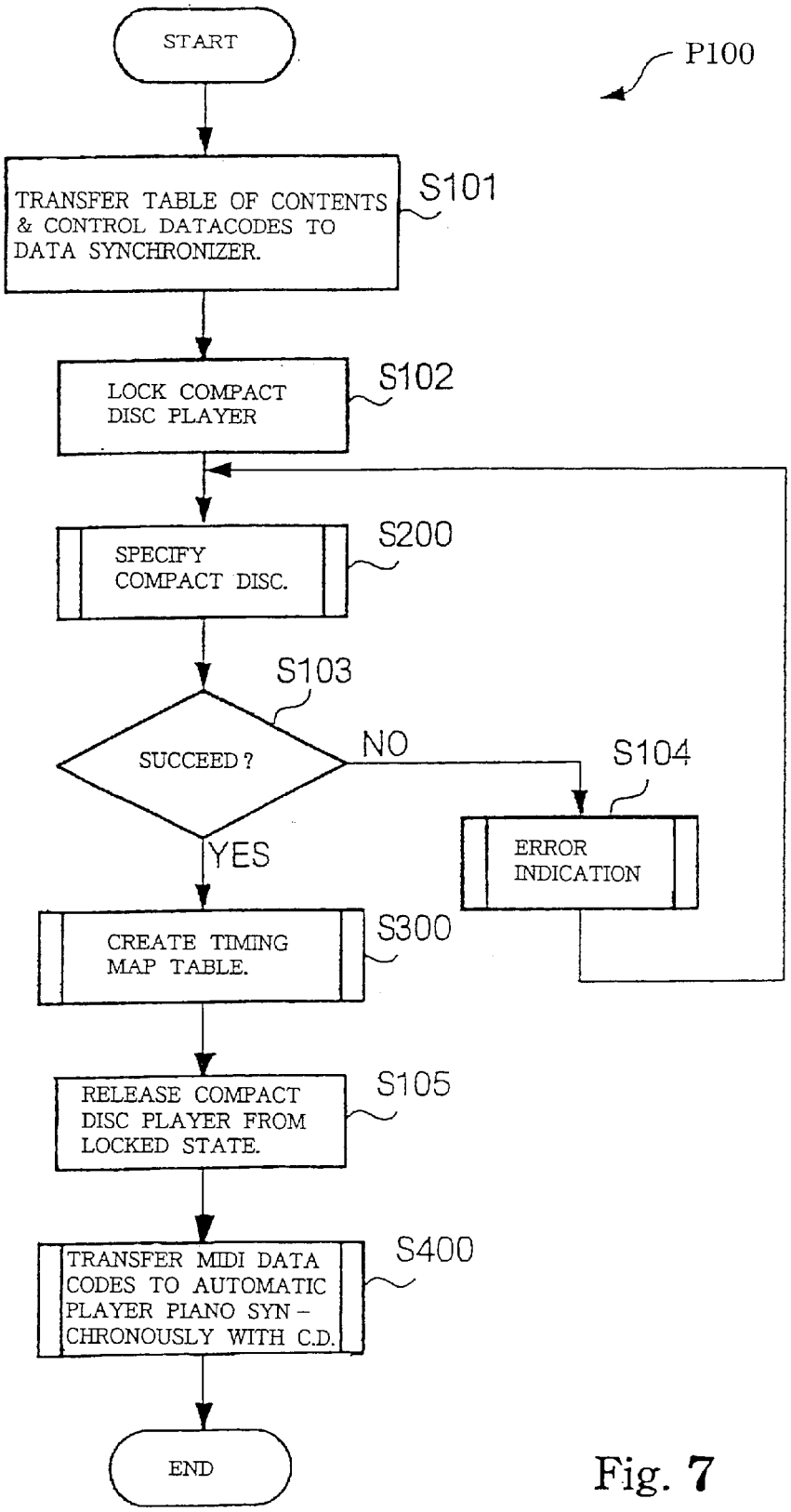
FIG. 7 is a flowchart showing a sequence of jobs for the ensemble system.

Description is hereinbelow made on an ensemble between the sound reproducer 1 and the automatic player piano 3. Assuming now that a compact disc 5 is loaded into the compact disc player 7, the ensemble system starts the program sequence P100 shown in FIGS. 7 and 8. First, the compact disc player 7 moves the pick-up to the innermost lane, and adjusts it to the read-in. When the servo is established for the signal processing, the compact disc player 7 reads the table of contents TOC through the pick-up as by step S101. Upon completion of the read-out, the compact disc player 7 supplies a control signal representative of the ready for playback to the data processing unit 12. Since the ensemble has been already requested, the data processing unit 12 supplies the request signal representative of the transfer of the table of contents to the compact disc player 7. The compact disc player 7 is responsive to the request signal so as to transfer the table of contents and the control data codes T1 to the data processing unit 12 as by step S101. The data processing unit 12 stores the table of contents and the control data codes T1 in the working memory.

Otherwise, when the compact disc 5 is loaded on the tray of the compact disc player 7, the compact disc player 7 drives the compact disc 5 for rotation. When the rotation becomes stable, the compact disc player 7 reads the table of contents from the compact disc 5, and supplies the table of the contents to the data processing unit 12. The data processing unit 12 periodically enters a sub-routine program through a timer interruption, and checks the interface to see whether or not the table of contents reaches there. If the table of contents have not reached, the data processing unit 12 immediately returns to the main routine program. On the other hand, if the table of contents has already reached, the data processing unit 12 fetches the table of contents, and, thereafter, returns to the main routine program.

Subsequently, the data processing unit 12 supplies a control signal representative of prohibiting a user from starting the playback. In other words, the compact disc player 7 is locked as by step S102. While the compact disc player 7 is being locked, the data processing unit 12 specifies the compact disc 5 already loaded into the compact disc player 7 as by step S200. As described hereinbefore, the data processing unit 12 compares the bit string representative of the table of contents with the bit strings stored in the data blocks B0 in the MIDI data table T3 to see whether or not the bit string is identical with any one of the bit strings stored in the MIDI data table T3. The data processing unit 12 evaluates the investigation, and gives a mark to the result. When the data processing unit 12 finds a bit string perfectly identical with the bit string representative of the table of contents, the data processing unit 12 gives the highest mark. If the bit string is almost identical with the bit string representative of the table of contents, the data processing unit 12 gives a mark depending upon the difference. However, when the data processing unit 12 does not find any bit string, the data processing unit 12 gives the lowest mark.

Upon completion of the comparison, the data processing unit 12 checks the mark to see whether or not the job at step S200 is successful as by step S103. If the data processing unit 12 finds the mark to be lower than a threshold, the answer at step S103 is given negative, and the data processing unit 12 proceeds to step S104.

The data processing unit 12 carries out countermeasure against the error at step S104. The data processing unit 12 notifies the error to the user. For example, the data processing unit 12 transfers massages such as, for example, "There is not the sets of MIDI data codes. Insert a new floppy disc, and you will load sets of MIDI data codes into the data synchronizer."

The user inserts a new floppy disc 6 into the floppy disc driver 10. Then, the floppy disc driver 10 reads out sets of MIDI data codes from the floppy disc 6. The data processing unit 12 fetches the sets of MIDI data codes from the floppy disc driver 10, and adds the new sets of MIDI data codes to the MIDI data table T3. When the new sets of MIDI data codes are stored in the MIDI data table T3, the data processing unit 12 returns to step S200, and repeats the jobs at steps S200 and S103.

On the other hand, when the data processing unit 12 finds the mark to exceed the threshold, the answer at step S103 is given affirmative, and the data processing unit 12 creates the timing map table T4 as by step S300. The timing map table has been already described hereinbefore, and no further description is incorporated.

Upon completion of the timing map table T4, the data processing unit 12 releases the compact disc player 7 from the locked state with a control signal as by step S105. When the compact disc player 7 is released from the locked state, the compact disc player 7 produces the audio signal from the audio data codes, and supplies the audio signal through the amplifier 8 to the speaker system 9. Accordingly, the data processing unit 12 synchronously transfers the MIDI data codes to the automatic player piano 3 as by step S400. When the last MIDI data code is transferred to the automatic player piano 3, the data synchronizer 1 terminates the synchronous data transfer, and waits for the next instruction.

Figure 8:
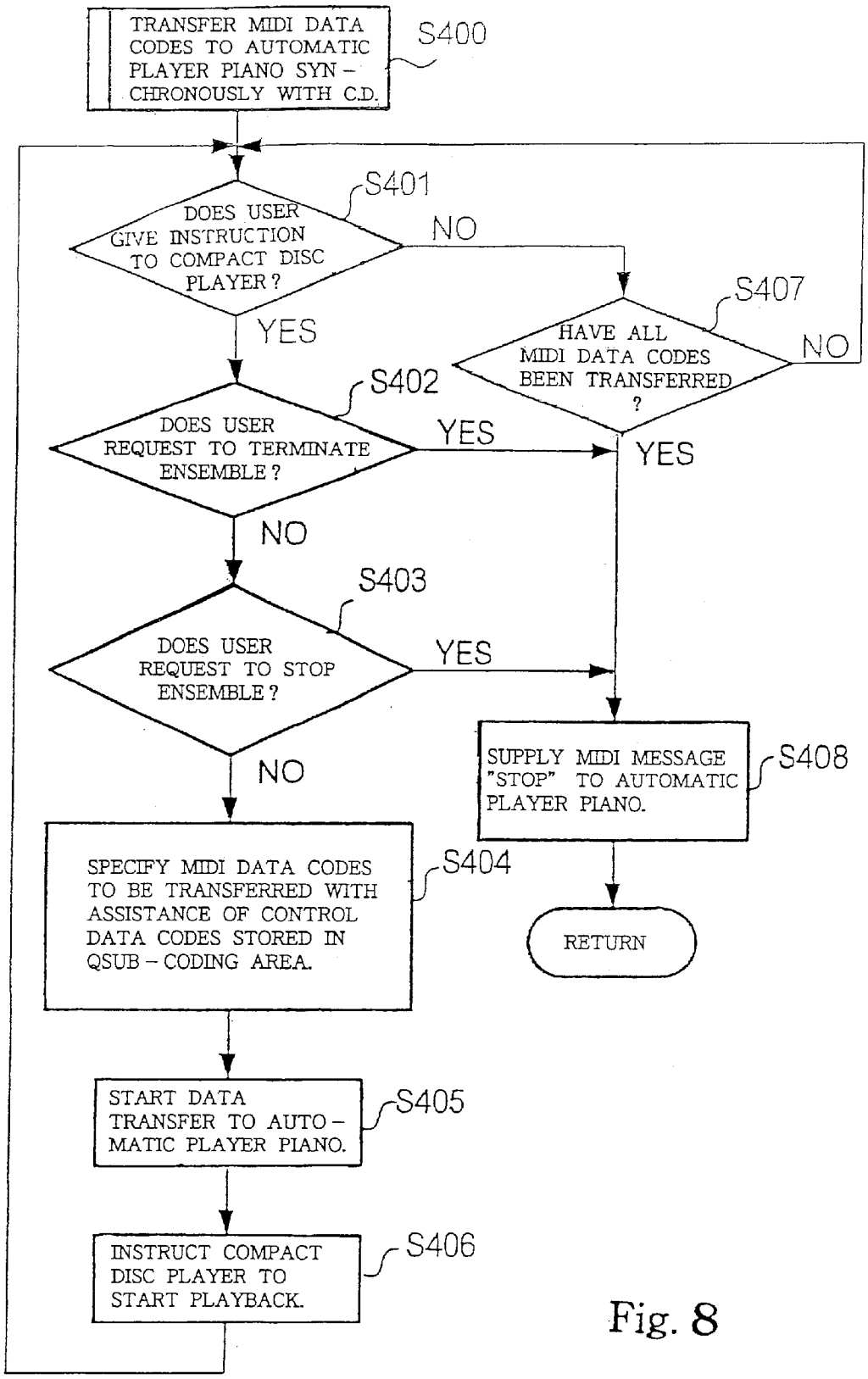
FIG. 8 is a flowchart showing a sequence of jobs for a synchronous data transfer.

When the data synchronizer 1 releases the compact disc player 7 from the locked state, the data processing unit 12 periodically repeats the control sequence shown in FIG. 8. The data processing unit 12 firstly checks the interface to see whether or not the compact disc player 7 notifies any user's instruction to the data synchronizer 1 as by step S401. When the user gives new instruction to the manipulation panel of the compact disc player 7, the compact disc player 7 sends an information signal representative of the user's instruction to the interface of the data processing unit 12. If the user has not given any instruction to the compact disc player 7, any information signal does not reach the interface, and the answer at step S401 is given negative. Then, the data processing unit 12 checks the internal pointer indicative of the identifier i to see whether or not all the MIDI data codes have been already transferred to the automatic player piano 3 as by step S407. Any MIDI data code has not been transferred to the automatic player piano 3, and the answer at step S407 is given negative. The data processing unit 12 returns to step S401, and reiterates the loop consisting of steps 401 and 407 until the answer at step S401 is changed to affirmative.

The user is assumed to give an instruction to the compact disc player 7. The compact disc player 7 supplies the information signal representative of the instruction to the interface of the data processing unit 12. The data processing unit 12 fetches the piece of control data information representative of the instruction, and checks the piece of control data information to see whether or not the user requests the ensemble system to terminate the ensemble as by step S402. The user has not been instructed the ensemble system to start the ensemble, yet. The answer at step S402 is given negative, and the data processing unit 12 checks the piece of control data information to see whether or not the user requests the ensemble system to stop the ensemble temporarily as by step S403. The answer at step S403 is presently to be given negative.

When the answers at steps S402 and S403 are given negative, the data processing unit 12 interprets the user's instruction as starting the ensemble, and proceeds to step S404. When the user instructed the compact disc player 7 to start the ensemble, the compact disc player 7 moved the pick-up to the first audio data code representative of the first tone of the selected musical composition, and supplies the control data codes representative of the number of the first movement of the selected musical composition and the time to be required for the reproduction to the data processing unit 12. Thus, the compact disc player 7 gets ready to start the playback, and waits for the control signal representative of the initiation to be supplied from the data synchronizer 1. With the control data signal supplied from the compact disc player 7, the data processing unit 12 selects the data file assigned to the set of MIDI data codes representative of the first movement from the timing map table T4, and specifies identifier i and, accordingly, the MIDI data codes corresponding to the frame.

When the data synchronizer 1 gets ready to start the ensemble, the data processing unit 12 starts the data transfer to the automatic player piano 3 as by step S405, and sends the control signal representative of the initiation of the playback to the compact disc player 7 as by step S406. The data synchronizer 2 firstly transfers the MIDI data code representative of the first event to the automatic player piano, and sequentially transfers the MIDI data codes representative of the second event toward the MIDI data code representative of the last event. The data processing unit 12 checks the timing data table T4 for the MIDI data codes to be transferred to the automatic player piano 3. The lapse of time from the initiation of the playback stored in the data fields F2 makes the data transfer synchronous with the audio data codes to be processed by the compact disc player 7. Thus, the data synchronizer 2 establishes the synchronization between the compact disc player 7 and the automatic player piano 3. The sound reproducer 1 and the automatic player piano 3 reproduce the selected musical composition in ensemble.

While the data synchronizer 2 is sequentially transferring the MIDI data codes to the automatic player piano 3, the user is assumed to instruct the compact disc player 7 to terminate the ensemble or stop the ensemble temporarily. When the user instructs the compact disc player 7 to terminate the playback, the compact disc player 7 stops the, and supplies the information signal representative of the user's instruction to the interface of the data processing unit 12. The answers at step S401 and S402 are given affirmative. Then, the data processing unit 12 acknowledges the user's instruction, and supplies the MIDI message "stop" to the automatic player piano 3 as by step S408. The MIDI messages "start" and "stop" are corresponding to the instructions given to the compact disc player 7 through a button "start playback" and a button "stop playback", respectively.

When the user instructs the compact disc player 7 temporarily to stop the playback, the compact disc player 7 stops the playback, and supplies the information signal representative of the temporal stop to the interface of the data processing unit 12. The answer at step S401 is given affirmative, but the answer at step S402 is given negative. Then, the data processing unit 12 checks the piece of information to see whether or not the user instructs the compact disc player 7 temporarily to stop the playback. The answer at step S403 is given affirmative, and the data processing unit 12 supplies the MIDI message "stop" to the automatic player piano 3 as by step S408.

When the user instructs the compact disc player 7 to restart the playback, the compact disc player 7 sends the control signal representative of starting the playback and the control data code from the Q-channel associated with the audio data code to be reproduced to the data processing unit 12. The data processing unit 12 passes through steps S401, S402 and S403, and reaches step S403. The data processing unit 12 obtains the piece of control data information representative of the lapse of time from the initiation to the audio data code at which the compact disc player 7 restarts the playback. The data processing unit 12 specifies the MIDI data code representative of the event to be firstly reproduced, and restarts the data transfer to the automatic player piano 3 as by step S405. Concurrently, the data processing unit 12 instructs the compact disc player 7 to restart the playback as by step S406.

The data processing unit 12 is assumed to transfer the MIDI data code representative of the last event to the automatic player piano 3. When the data processing unit 12 reaches step S407, the answer is given affirmative. The data processing unit proceeds to step S408, and supplies the MIDI message "stop" to the automatic player piano 3. The automatic player piano 3 terminates the playback, and the compact disc player 7 concurrently terminates the playback.

As will be understood, the data synchronizer 2 transfers the MIDI data codes to the automatic player piano synchronously with the information processing in the compact disc player 7 by virtue of the timing map table T4. The audio data codes are supplied from a compact disc 5 to the compact disc player 7, and the MIDI data codes are supplied from the floppy disc 6 to the data synchronizer 2. The compact discs 5 and the floppy discs 6 are sold in the market, and any composite compact disc, in which both audio and MIDI data codes are stored, is never required for the ensemble.

The internal communication is established between the compact disc player 7 and the data synchronizer 2. When the user gives an instruction to the compact disc player 7, the instruction is relayed to the data synchronizer. For this reason, the user gives the instructions to only the compact disc player 7. This means that the ensemble system does not require the complicated manipulations on both apparatus.

Even if the user instructs the compact disc player 7 to restart the reproduction in the middle of a musical composition, the data synchronizer 2 searches the timing map table T4 for the MIDI data code corresponding to the tone at which the compact disc restarts, and restarts the ensemble together with the compact disc player 7.

Second Embodiment

Figure 9:
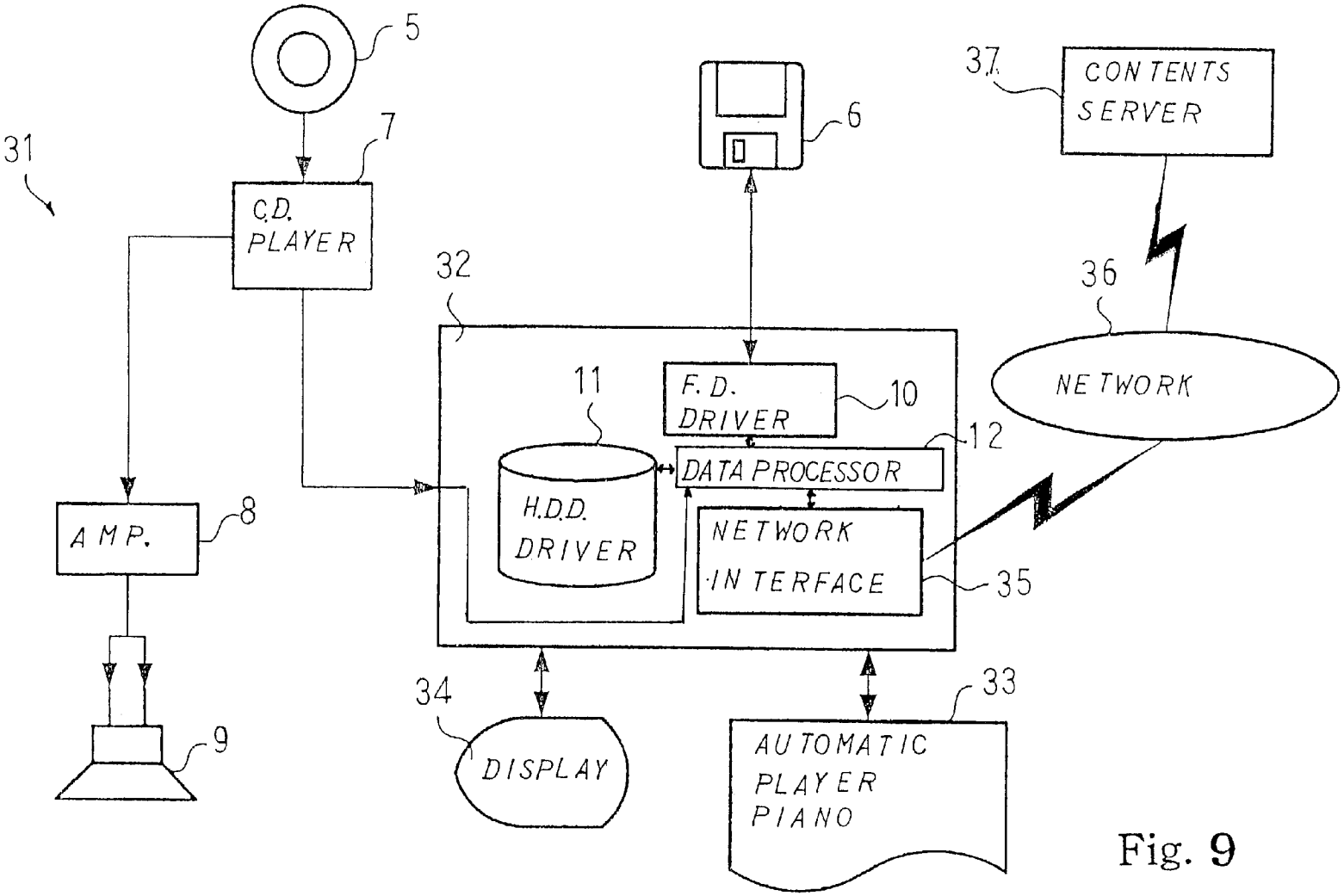
FIG. 9 is a schematic view showing the system configuration of another ensemble system according to the present invention.

Turning to FIG. 9 of the drawings, another ensemble system embodying the present invention comprises a sound reproducer 31, a data synchronizer 32, an automatic player piano 33 and a display 34. The sound reproducer 31 is similar in system configuration to the sound reproducer 1, and, for this reason, the components are labeled with the references designating corresponding components of the sound reproducer 1 without detailed description. The automatic player piano 33 and the display 34 are corresponding to the automatic player piano 3 and the display 4, and no further description is incorporated hereinbelow.

A network interface 35 is added to the data synchronizer 32. Other components are similar to those of the data synchronizer 2, and are labeled with the references designating corresponding components of the data synchronizer 2. The network interface 35 is connectable to a network 36 such as the internet, and a contents server 37 forms a part of the network 36. The contents server 37 has a suitable memory where the MIDI data table T3 is stored. This means that the MIDI data table T3 is not created in the hard disc 11. For this reason, the compact disc 5 is specified by the contents server 37 in this instance.

Figure 10:
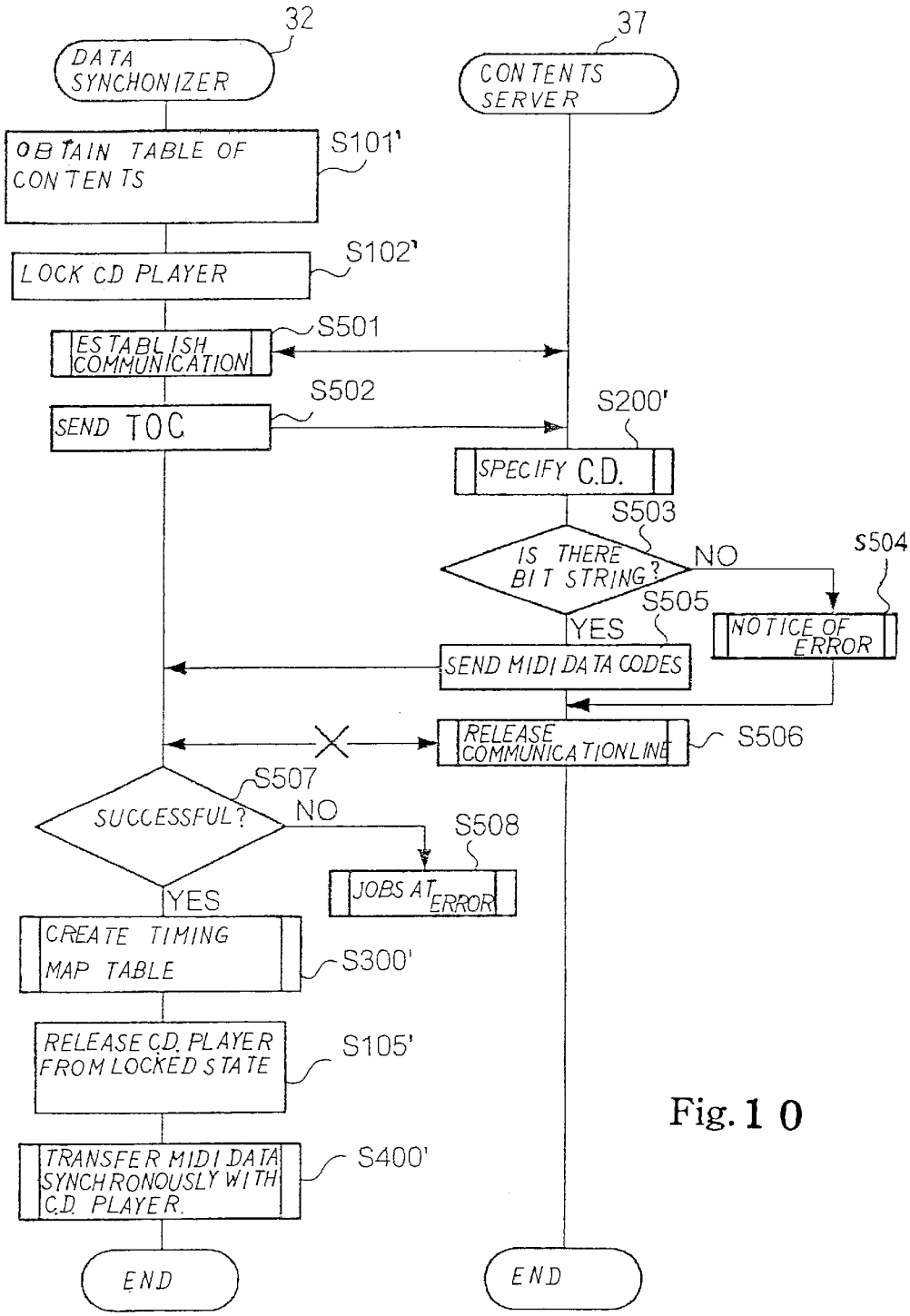
FIG. 10 is a flowchart showing a sequence of jobs for the ensemble system.

When a user requests the ensemble system to play a musical composition in ensemble, the ensemble system reproduces the musical composition through a control sequence shown in FIG. 10. The data synchronizer 32 achieves jobs in the left column, and the jobs in the right column are achieved by the contents server 37.

The user is assumed to insert a compact disc 5 into the slots. The compact disc 5 is loaded in the compact disc player 7, and the compact disc player 7 reads the table of contents from the read-in section of the compact disc 5. The table of contents is transferred to the data synchronizer 32 as similar to the ensemble system implementing the first embodiment. Thus, the data synchronizer 32 obtains the table of contents as by step S101'.

Subsequently, the data synchronizer 32 sends the control signal to the compact disc player 7 so as not to respond to user's instruction. Thus, the compact disc player 7 is locked as by step S102'.

The data processing unit 12 connects the network interface 35 through a communication line to the contents server 37. Thus, a communication is established between the data synchronizer 32 and the contents server 37 as by step S501. When the network interface 35 is connected through the communication line to the contents server 37, the data processing unit 12 sends a data signal representative of the table of contents, i.e., TOC to the contents server 37. After reception of an acknowledgement from the contents server 37, the data synchronizer 32 stands by until the contents server 37 completes the following jobs.

The contents server 37 firstly searches the MIDI data table T3 for a bit string identical with the bit string representative of the table of contents as by step S200'. In other words, the contents server 37 sequentially compares the bit strings stored in the data blocks B0 (see FIG. 4) with the bit string representative of the table of contents supplied form the data synchronizer 32. Upon completion of the table search, the contents server 37 asks itself whether or not there is a bit string identical with the bit string supplied form the data synchronizer 32 as by step S503. If the contents server 37 has not found any bit string identical with the bit string representative of the table of contents, the answer at step S503 is given negative, and the contents server 37 transfers an error message through the communication line to the data synchronizer so that the data processing unit 12 produces the error message on the display 34 as by step S504. Thereafter, the contents server 37 releases the communication line as by step S506.

On the other hand, if the contents server 37 finds a bit string identical with the bit string supplied from the data synchronizer 32, the answer at step S503 is given affirmative. Then, the contents server 37 reads out sets of MIDI data codes from the same data file of the MIDI data table T3, and sends the sets of MIDI data codes through the communication line to the data synchronizer 32 as by step S505. Finally, the contents server 37 notifies the data synchronizer 32 of releasing the communication line. Upon completion of the communication to the data synchronizer 32, the contents server 37 releases the communication line as by step S506, and terminates the data processing.

When the contents server 37 notifies the release of the communication line to the data synchronizer 32, the data synchronizer 32 restarts the data processing. Firstly, the data synchronizer 32 checks the working memory to see whether or not all the MIDI data codes have been stored. In other words, the data synchronizer 32 asks itself whether or not the data transfer is successful as by step S507. If the contents server 37 fails to specify the compact disc 5 loaded into the compact disc player 7, or if part of the MIDI data codes does not reach the data synchronizer 32, the answer at step 507 is given negative. Then, the data synchronizer 32 makes an error option. If the error is due to the failure in specifying the compact disc 5, the data processing unit 12 produces an error message on the display 34. On the other hand, when part of the MIDI data codes did not reach the data synchronizer 32, the data processing unit 12 establishes the communication between the network interface 35 and the contents server 37, again, and requests the contents server 37 to send the sets of MIDI data codes. In other words, the jobs at steps S101' to S506 are repeated.

On the other hand, when the data synchronizer 32 confirms that all the MIDI data codes have been stored in the working memory, the answer at step S507 is given affirmative, and the data processing unit 12 creates the timing map T4 as by step S300'. The job at step S300' is similar to that at step S300, and the description is omitted for avoiding repetition. Upon completion of the timing map table T4, the data processing unit 12 sends the control signal representative of the release of the compact disc player 7 from the locked state as by step S105', and starts to transfer the MIDI data codes to the automatic player piano 33 synchronously with the data processing in the compact disc player S400'. The jobs at step S400' are similar to those of step S400, and are detailed in FIG. 8. For this reason, the description is not repeated hereinbelow.

As will be understood from the foregoing description, the data synchronizer 32 transfers the MIDI data codes to the automatic player piano 33 synchronously with the playback through the sound reproducer 31. The timing map table establishes the synchronization between the data transfer to the automatic player piano 33 and the compact disc player 7 without any composite information storage medium. In other words, even though the audio data codes and the MIDI data codes are separately stored in the compact disc 5 or CD-DA and the memory of the contents server 37, the data synchronizer 32 creates the timing map table T4, and achieves the ensemble between the automatic player piano 33 and the compact disc player 7.

In this instance, the MIDI data table T3 is stored in the memory of the contents server 37. The contents server 37 specifies the compact disc 5 loaded in the compact disc player 7, and supplies the MIDI data codes corresponding to the audio data codes to the data synchronizer 32. Thus, the user obtains the MIDI data codes from the contents server 37 through the downloading. The data acquisition through the down-load is economical rather than purchasing the floppy disc 6, because the contents provider does not need any physical information storage media such as the floppy disc 6.

The data acquisition through the down-load is further desirable for the contents provider from the viewpoint of the market research. When the contents server 37 fails to find the bit string identical with the bit string representative of the table of contents, the contents server 37 notifies the contents provider of the request from the users, and makes the contents provider notice the demand for new compact discs.

Third Embodiment

Figure 11:
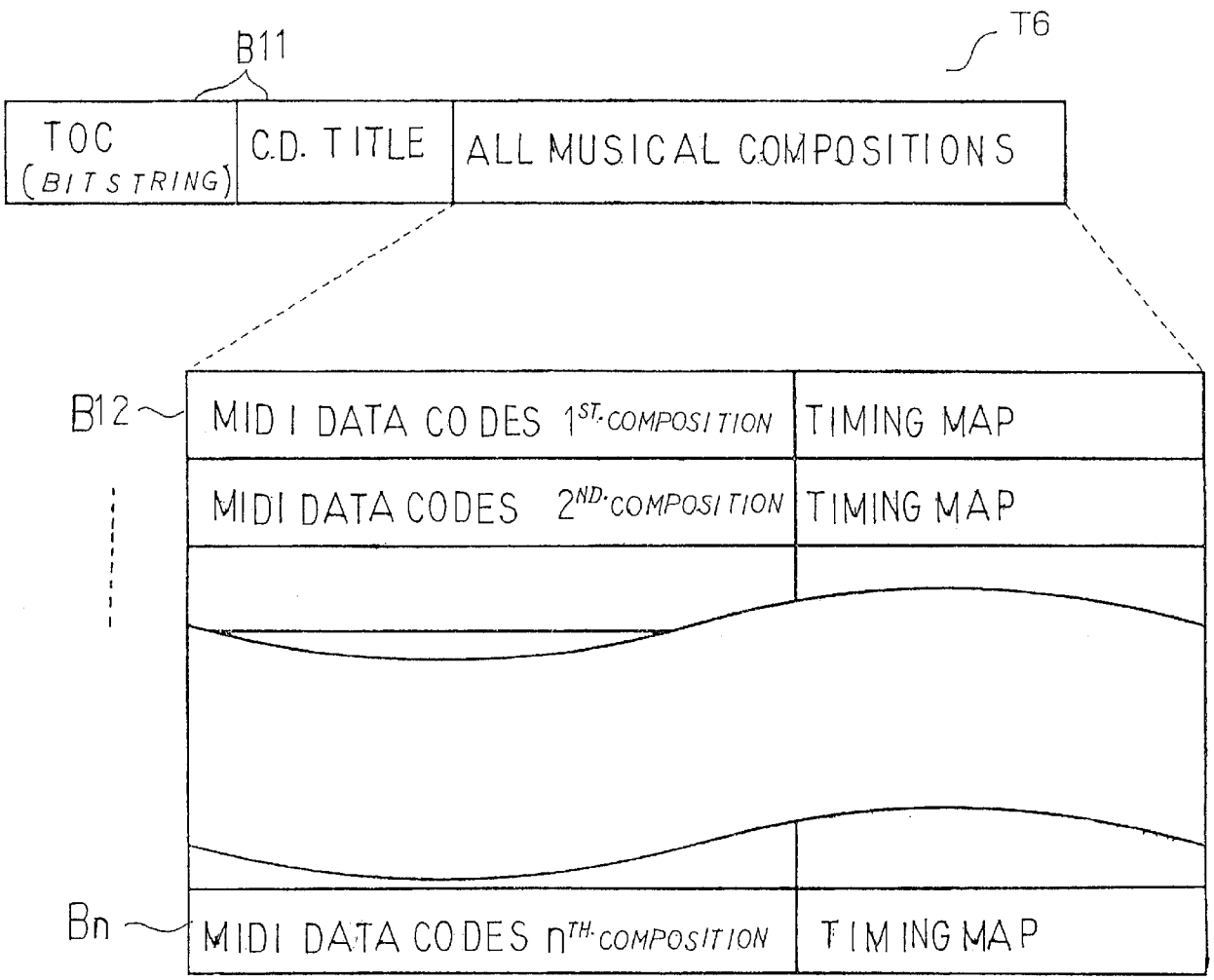
FIG. 11 is a view showing a composite table stored in yet another ensemble system according to the present invention.

FIG. 11 shows a composite table T6 stored in a contents server communicable with an ensemble system embodying the present invention. The composite table T6 is equivalent to the combination of the MIDI data table T3 and the timing map table T4. The system configuration is similar to that of the ensemble system implementing the second embodiment. For this reason, components of the ensemble system implementing the third embodiment are labeled with the references designating corresponding components of the ensemble system implementing the second embodiment without detailed description.

The composite table T6 includes plural data files respectively assigned to music compact discs. One of the data files is illustrated in FIG. 11. The data file includes a data block B11 assigned to a bit string representative of a table of contents and a title of the music compact disc and plural data blocks B11 to **B1*n* respectively assigned to the musical compositions stored in the music compact disc. Each of the data blocks B11 to B1*n* has a data record assigned to a set of MIDI data codes representative of the first musical composition and another data records assigned to a timing map table for synchronization between the data processing on the audio data codes and the data transfer of the MIDI data codes. The data blocks B11 and the data records assigned to the MIDI data codes are corresponding to the MIDI data table T3, and the data records assigned to the timing map tables are equivalent to the timing map table T4**. Thus, the timing map tables have been prepared by the contents provider, and are stored in the memory together with the MIDI data table.

When the data synchronizer 32 supplies the bit string representative of the table of contents read out from the compact disc 5, the contents server 37 searches the composite table T6 for a bit string identical with the bit string supplied from the data synchronizer 32 (see step S200'). If the contents server 37 finds the bit string in the composite table T6, the contents server 37 reads out the timing map tables as well as the sets of MIDI data codes from the data file specified with the table of contents, and supplies the timing map tables and the sets of MIDI data codes to the data synchronizer 32 (see step S505). Thus, the timing map tables are supplied from the contents server 37 to the data synchronizer 32, and the data synchronizer 32 does not creates the timing map table. For this reason, step S300' is moved from the left column to the right column in FIG. 10.

Thus, the timing map tables are created by the contents provider, and the data processing unit 12 is not expected to create the timing map table. When the MIDI data codes and the timing map table reach the data synchronizer 32, the data processing unit 12 releases the compact disc 7 from the locked state, and immediately starts the ensemble between the sound reproducer 31 and the automatic player piano 33.

Fourth Embodiment

Figure 12:
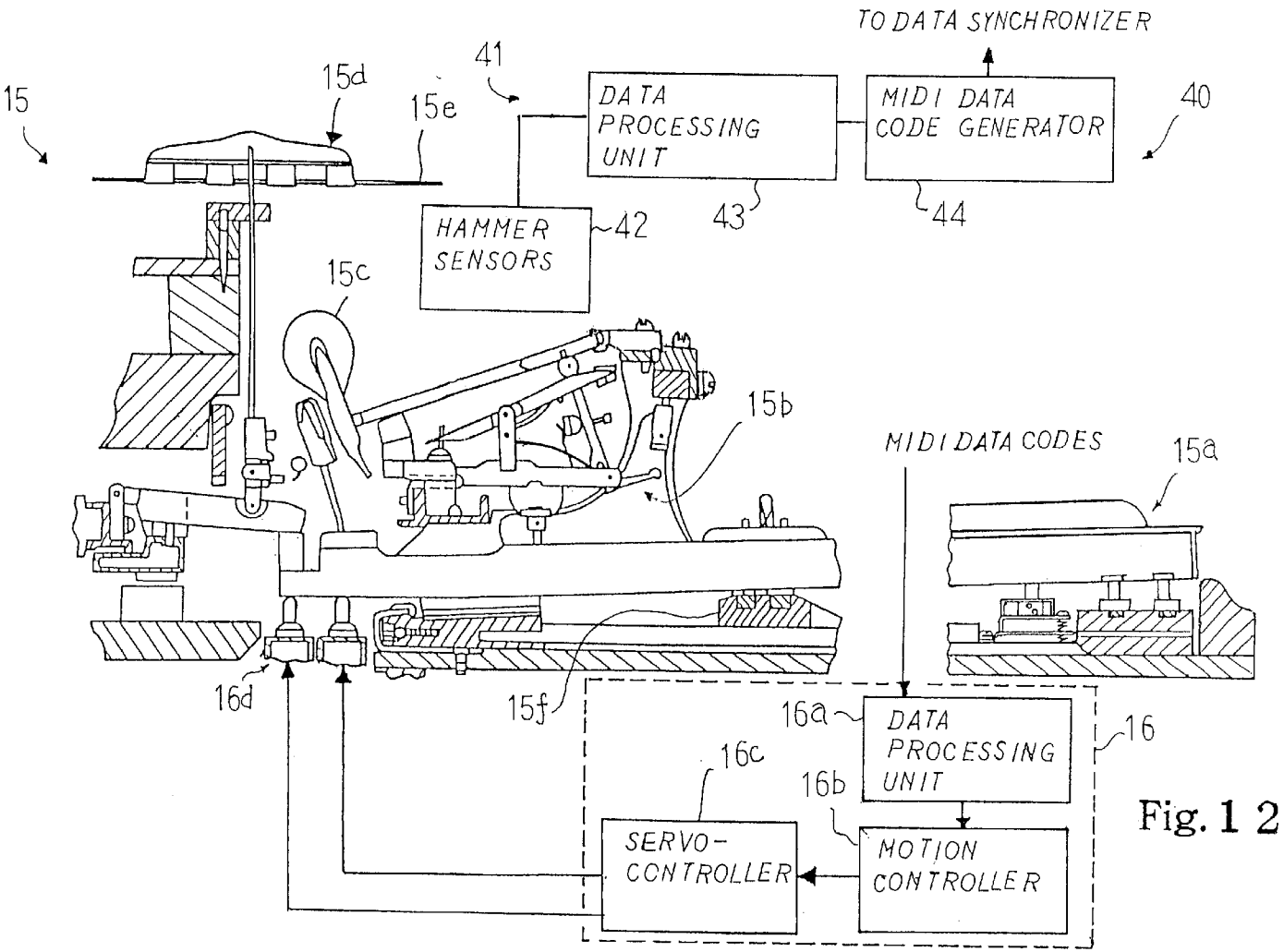
FIG. 12 is a schematic side view showing the structure of an automatic player piano incorporated in still another ensemble system according to the present invention.

Turning to FIG. 12 of the drawings, still another ensemble system embodying the present invention includes an automatic player piano 40 instead of the automatic player piano 3. The sound reproducer 1, the data synchronizer 2 and the display 4 are further incorporated in the ensemble system. However, description is not made on these components for the sake of simplicity. The automatic player piano 40 is a combination of the acoustic piano 15, the automatic playing system 16 and a MIDI data generating system 41. The automatic playing system 16 and the MIDI data generating system 41 are connected to the interface of the data processing unit 12, and MIDI data codes are bi-directionally transferred between the automatic player piano 40 and the data synchronizer 2. Thus, the automatic player piano 40 serves as a data source as well as the sound generator.

The MIDI data generating system 41 comprises an array of hammer sensors 42, a data processing unit 43 and a MIDI data code generator 44. The hammer sensors 42 are respectively associated with the hammers **15*c*, and reports current hammer positions to the data processing unit 43. The data processing unit 43 periodically checks the data input port assigned to the hammer position signals to see whether or not any one of the hammers 15*c* is driven for rotation. When a hammer 15*c* changes the current hammer position, the data processing unit 43 specifies the black/white key depressed by the pianist, and determines the key code assigned the depressed black/white key. The data processing unit 43 accumulates the pieces of positional information representative of the current hammer positions varied with time, and calculates the hammer velocity. The data processing unit 43 further supposes a time to depress the black/white key, a time to strike the string 15***e* and a time to release the black/white key. The data processing unit 43 supplies the pieces of music data information representative of the key code, the hammer velocity, the time to depress the black/white key, the time to strike the string 15*e* and the time to release the black/white key to the MIDI data code generator 44. The MIDI data code generator 44 stores those pieces of music data information in MIDI data codes, and supplies the MIDI data codes to the data synchronizer 2. The data processing unit 43 may obtain the pieces of music data information on the basis of current key position signals supplied from an array of key sensors.

The automatic player piano 40 behaves as similar to the automatic player piano 3 in ensemble, and description is omitted for the sake of simplicity. As described hereinbefore, the automatic player piano 40 serves as a data source.

A pianist is assumed to instruct the data synchronizer 2 to record an ensemble between his or her performance and the compact disc player 7. The compact disc 5 has been already loaded into the compact disc player 7. The pianist instructs the compact disc player 7 to start the playback, and fingers the piece of music on the keyboard 15*a*. The MIDI data generating system 41 sequentially converts the hammer motion to the MIDI data codes, and supplies the MIDI data codes to the interface of the data processing unit 12. The data synchronizer 2 has a real time data input function similar to that of a MIDI sequencer, and the MIDI data codes are stored in the hard disc 11. The data synchronizer 2 further acquires the control data codes stored in the Q-channel in the sub-cording area of the compact disc 5 so as to specify the musical composition presently reproduced.

When the pianist finishes the performance, the data synchronizer 2 requests the compact disc player 7 to send the table of contents TOC. The data synchronizer 2 creates a MIDI data table T3, and the set of MIDI data codes is stored in a suitable data block corresponding to the musical composition already reproduced. The pianist may input the title of the compact disc in the data block B0 of the same data file. The pianist may not perform all the musical compositions stored in the compact disc 5. If so, the MIDI data codes are stored in the data blocks assigned to the reproduced musical compositions, and the data synchronizer 2 leaves the other data file free.

After the creation of the MIDI data table T3, the data synchronizer 2 is responsive to the request for ensemble. When the user requests the compact disc player 7 to reproduce the ensemble, the data synchronizer 2 creates the timing map table T4, and transfers the MIDI data codes to the automatic player piano 40 synchronously with the data processing on the audio data codes as similar to the ensemble system shown in FIG. 1.

The ensemble system achieves all the advantages as similar to the ensemble system implementing the first embodiment.

As will be appreciated from the foregoing description, although the audio data codes have the pieces of timing data information differently defined from the pieces of timing data information stored in the MIDI data codes, the data synchronizer according to the present invention converts the pieces of timing data information stored in the MIDI data codes to pieces of timing data information defined in the same manner as the pieces of timing data information stored in the audio data codes. As a result, the data synchronizer is able to send the MIDI data codes to the sound source, i.e., the automatic player piano synchronously with the playback through the other data source or the compact disc player 7.

In the above-described embodiments, the MIDI data codes and the audio data codes are corresponding to a first sort of music data codes and a second sort of music data codes, respectively, and the automatic player piano and the sound reproducer respectively serve as a first sound source and a second sound source, respectively. The first rule is that the step times define the time intervals of events, and the second rule is that each frame is specified by the lapse of time from the initiation. The data processing unit 12 at step S300 serves as a mapping means, and the data processing unit 12 at step S400 serves as a transmitting means. The working memory of the data processing unit 12 and the hard disc 11 as a whole constitute a memory. The data processing unit 12 at step S200 serves as a searching means. The data processing unit 12 at steps S502/S505 serves as a communicating means together with the network interface 35.

Modifications

Although particular embodiments of the present invention have been shown and described, it will be apparent to those skilled in the art that various changes and modifications may be made without departing from the spirit and scope of the present invention.

For example, the sets of MIDI data codes may be read out from a floppy disc 6 when the MIDI data table T3 is to be created. The MIDI data table T3 may be created in a free area of the floppy disc 6. The MIDI data table T3 may be prepared by a manufacturer in the form of a CD-ROM (Compact Disc Read Only Memory) disc or an MO (Magneto-Optical) disc. In this instance, the data synchronizer includes a suitable disc driver so as to read out the contents of the MIDI data table from the CD-ROM disc or the MO disc.

Figure 13:
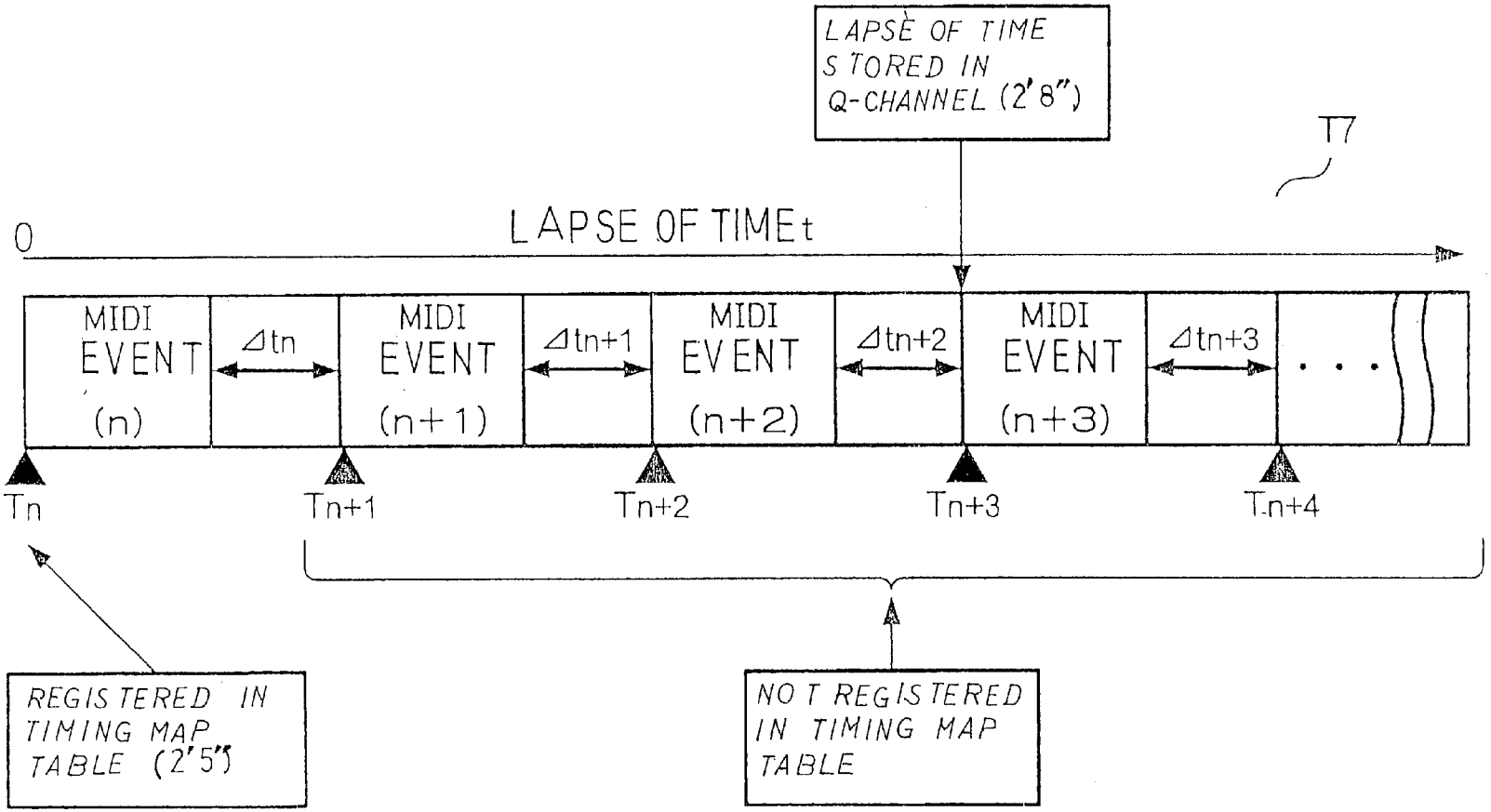
FIG. 13 is a view showing a series of events, a part of which is registered in a timing map table.

In the above-described embodiments, all the MIDI data codes representative of the events are mapped to the frames. However, only the MIDI data codes representative of unique events may be mapped to the frames. The MIDI data code representative of a bar is a typical example of the unique event. FIG. 13 illustrates how an event is specified on the basis of the lapse of time stored in the control data code in the Q-channel. A control data code indicates that the frame is to occur at 2' 8". The MIDI data code representative of the event (n) is registered in the timing map table, and the event (n) is to occur at 2' 5". However, the MIDI data codes representative of the events (n+1), (n+2), (n+3), (n+4) . . . are not registered. Tn is a step time or the time interval between the event (n) and the next event (n+1). Similarly, Tn+1, Tn+2, Tn+3 and Tn+4 are step times between the adjacent two events. In this situation, the data processing unit searches the timing map table for a MIDI data code representative of the event to occur immediately before the time 2' 8". The data processing unit selects the MIDI data code representative of the event (n) from the timing map table. Subsequently, the data processing unit adds the step time Tn to the time when the event (n) is to occur, i.e., 2' 5", and compares the sum (2' 5"+Tn) with the target lapse of time 2' 8". If the sum does not reach the target lapse of time, the data processing unit further adds the step time Tn+1 to the sum, and compares the total sum (2' 5"+Tn+Tn+1) with the target lapse of time. If the answer is still negative, the data processing unit further adds the step time Tn+2, and compares the total sum (2' 5'+Tn+Tn+1+Tn+2) with the target lapse of time. The answer is still negative. Then, the data processing unit further adds the next step time Tn+3 to the total sum, and compares the result with the target lapse of time. The total sum 2' 5'+(Tn to Tn+3) is equal to the target lapse of time. Then, the data processing unit decides that event (n+3) is to occur at 2' 8". The data processing unit transfers the MIDI event data representative of the event (n+3) to the sound source, i.e., the automatic player piano at 2' 8", and intermittently transfers the other MIDI data codes representative of the events (n+4) . . . at time intervals equal to the step times Tn+4, . . . . Thus, even if all the frames are not mapped to the MIDI event codes representative of the events, the data synchronizer can transfer the MIDI data codes to the sound source synchronously with the playback through the sound reproducer. This feature is desirable, because the data processing unit quickly creates the timing map table. In other words, the user does not need to wait for a long time until the playback in ensemble.

Even if any timing map table has not been prepared, the data processing unit may synchronize the data transfer with the playback through the sound reproducer through the method illustrated in FIG. 13. The data processing unit maps each frame scheduled at a certain time to a MIDI data code representative of an event to occur at the certain time. The data transfer is intermittently synchronized with the playback, and transfers the MIDI data codes between the synchronous points at time intervals equal to the step times.

In a modification of the ensemble system implementing the second embodiment, a local MIDI data table may be created in the hard disc 11. In this instance, the data processing unit 12 firstly checks the local MIDI data table to see the whether or not any one of the bit strings is consistent with the bit string representative of the table of contents TOC of the given compact disc. If the data processing unit 12 fails to find the bit string, the data processing unit searches the floppy disc 6 to see whether or not the bit string is found therein. If the data processing unit 12 fails to find the bit string, again. The data processing unit 12 accesses the contents server 37 through the communication line, and requests the contents server 37 to send the set of MIDI data codes representative of the musical composition specified with the table of contents TOC. The contents server 37 searches the memory for a bit string identical with the bit string representative of the table of contents. When the contents server 37 finds the bit string in the memory, the set of MIDI data codes is transferred from the contents server 37 to the data synchronizer. Thus, the modification carries out the data processing in a seamless fashion.

In another modification of the ensemble system implementing the second embodiment, the data synchronizer may be communicable with plural contents servers incorporated in the network 36. In this instance, the data synchronizer may have a list of the contents providers. When a user wishes to play a musical composition in ensemble, the user searches the list for a contents provider who may have the set of MIDI data codes representative of the musical composition, and instructs the data processing unit to establish the communication line to the contents server of the selected provider. If the set of MIDI data codes is not found, the user selects another contents provider from the list. Thus, the data synchronizer selectively accesses the MIDI data tables created in the different contents servers, and acquires a set of MIDI data codes from one of the contents servers.

Any kind of musical instrument is available for the ensemble system in so far as the musical instrument is responsive to the MIDI data codes. Similarly, any kind of sound reproducer, which reproduces a piece of music from a set of audio data codes, can form a part of the ensemble system. If a time lag is serious between the sound sources, a delay circuit may be inserted in the signal propagation path to the slow sound source.

In the above-described embodiments, the compact disc is specified by using the table of contents. The table of contents does not set any limit on the present invention. Any kind of bit string is available for the identification. For example, the data synchronizer acquires several audio data codes for each musical composition, and analyzes the audio data codes to see what notes form a musical passage. The musical composition may be specified by using the bit string representative of the notes, and the list of the bit strings is available for the identification of the compact disc.

The functions of the data synchronizer may be provided to the users in the form of a computer program stored in a CD-ROM, and the user installs the computer program in the data synchronizer for version-up. A personal computer may serve as the data synchronizer.

The floppy disc driver 10 may be separated from the data synchronizer 2. In this instance, the data processing unit 12 is connected through the data interface to the floppy disc driver 10.

The bit string representative of the table of contents may be changed to a simple bit string. In this instance, the bit strings TOC in the hard disc 11 are also changed to simple bit strings. A typical example of the preliminary data conversion is the normalization through a FFT (Fast Fourier Transformation).

Any kind of symbols/codes is available for the timing map table in so far as the identifier makes each event unique. For example, the compact discs for music are labeled with unique trade codes, respectively. In other words, users can specify a compact disc by using the trade code. The trade codes may be stored in the data blocks B0 of the MIDI data table T3.

The user may give instructions to the data synchronizer 2 so that the instructions are transferred from the data synchronizer 2 to the compact disc player 7.

Each of the ensemble systems implementing the reproduces plural parts of a musical composition on the basis of the audio data codes and the MIDI data codes through plural sound sources. However, two sorts of music data codes are never limited to the audio data codes and the MIDI data codes. The data synchronizer according to the present invention is useful for a user who wishes to play a musical composition in ensemble on the basis of plural sorts of music data codes differently defined in timing to reproduce the tones. The audio data codes in the music compact disc and the MIDI data codes never set a limit to "sorts of music data codes".

What is claimed is:

1. A data synchronizer for transmitting a first sort of music data codes to a first sound source synchronously with a playback through a second sound source on the basis of a second sort of music data codes, comprising:

a memory storing said first sort of music data codes representative of pieces of music data information defining a plurality of first tones of a music passage to be produced and first pieces of timing data information defining first times to produce said first tones in accordance with a first rule and at least second pieces of timing data information stored in said second sort of music data codes and defining second times to produce a plurality of second tones of said music passage in accordance with a second rule different from said first rule;

a mapping means having third times produced from said first times and defined in accordance with said second rule for mapping at least selected ones of the music data codes of said second sort to the certain music data codes of said first sort; and a transmitting means for transferring said music data codes of said first sort to said first sound source in such a manner that the first tones corresponding to said certain music data codes are produced concurrently with the second tones corresponding to said at least selected ones.

2. The data synchronizer as set forth in claim 1, in which said first pieces of timing data information define time intervals each between two events successively to occur in the production of said plurality of first tones, and said second pieces of timing data information define lapses of time from a reference time to second tones to be produced on the basis of pieces of music data information stored in said music data codes of said second sort.

3. The data synchronizer as set forth in claim 2, in which said music passage includes a certain second tone at the head of a movement or musical composition, and said certain second tone starts at said reference time.

4. The data synchronizer as set forth in claim 2, in which said music data codes of said first sort are formatted in accordance with standards of MIDI (Musical Interface Digital Interface), and said music data codes of said second sort are formatted in accordance with standards for CD-DA (Compact Disc Digital Audio).

5. The data synchronizer as set forth in claim 2, in which said mapping means creates a table defining relations between the events to occur and said third times and between said third times and locations at which the music data codes of said second sort representative of the pieces of music data information defining said second tones are stored.

6. The data synchronizer as set forth in claim 1, said music data codes of said first sort are selected from plural sets of music data codes of said first sort by using a bit string representative of contents of an information storage medium for storing said music data codes of said first sort.

7. The data synchronizer as set forth in claim 6, in which said information storage medium is a music compact disc.

8. The data synchronizer as set forth in claim 7, in which said music compact disc stores a table of contents, and said bit string represents said table of contents.

9. The data synchronizer as set forth in claim 6, in which said bit string is representative of the second tones in a head portion of said music passage.

10. The data synchronizer as set forth in claim 6, further comprising a searching means searching said memory for a bit string identical with said bit string so as to select said music data codes of said first sort from said plural sets of music data codes.

11. The data synchronizer as set forth in claim 6, further comprising a communicating means sending said bit string and receiving said music data codes of said first sort through a communication line.

12. A method for transmitting music data codes of a first sort to a first sound source synchronously with a playback through a second sound source on the basis of music data codes of a second sort, comprising the steps of:

a) acquiring said music data codes of said first sort representative of first pieces of music data information defining a plurality of first tones of a music passage and first pieces of timing data information defining first times to produce said first tones in accordance with a first rule and at least second pieces of timing data information stored in said music data codes of said second sort and defining second times to produce a plurality of second tones of said music passage in accordance with a second rule different from said first rule;

b) converting said first times to third times defined in accordance with said second rule;

c) instructing said second sound source to start said playback; and d) transferring said music data codes of said first sort to said first sound source in such a manner that the first tones corresponding to said certain music data codes are produced concurrently with the second tones corresponding to said at least selected ones.

13. The method as set forth in claim 12, in which said music data codes of said first sort and said music data codes of said second sort are supplied from a first data source and a second data source different from said first data source, respectively.

14. The method as set forth in claim 12, in which said first rule is standards of MIDI (Musical Instrument Digital Interface), and said second rule is standards of CD-DA (Compact Disc Digital Audio).

15. The method as set forth in claim 12, in which said step a) includes the sub-steps of a-1) specifying said music passage containing said plurality of second tones, a-2) searching a database for said music data codes of said first sort with a symbol representative of said plurality of second tones, and a-3) requesting said database to send said music data codes of said first sort.

16. The method as set forth in claim 15, in which said symbol is a bit string representing a table of contents stored in an information storage medium together with said music data codes of said second sort.

17. The method as set forth in claim 12, in which said first pieces of timing data information define time intervals each between two events successively to occur in the production of said plurality of first tones, and said second pieces of timing data information define lapses of time from a reference time to second tones to be produced on the basis of pieces of music data information stored in said music data codes of said second sort, and said step b) includes the sub-steps of b-1) adding first two time intervals to each other for obtaining a sum of time intervals, b-2) determining whether or not said sum is equal to one of said lapses of time, b-3) determining that one of said third times is equal to said sum when the answer at said sub-step b-2) is given affirmative without execution of the sub-steps of b-4), b-5), b-6) and b-7)

b-4) adding the next time interval to said sum for obtaining a total sum of time intervals when the answer at said sub-step b-2) is given negative, b-5) determining whether or not said total sum is equal to said one of said lapses of time, b-6) determining said one of said third times is equal to said total sum when the answer at said sub-step b-5) is given affirmative, and b-7) repeating said sub-steps b-4) and b-5) for successively accumulating said time intervals until said total sum reached said one of said third times; and b-8) repeating said sub-steps b-1) to b-7) for the other third times.

18. An ensemble system comprising:

a first sound source for producing first tones of a music passage on the basis of a first sort of music data codes;

a second sound source for producing second tones of said music passage on the basis of a second sort of music data codes; and a data synchronizer including a memory storing said first sort of music data codes representative of pieces of music data information defining a plurality of first tones of a music passage to be produced and first pieces of timing data information defining first times to produce said first tones in accordance with a first rule and at least second pieces of timing data information stored in said second sort of music data codes and defining second times to produce a plurality of second tones of said music passage in accordance with a second rule different from said first rule, a mapping means having third times produced from said first times and defined in accordance with said second rule for mapping at least selected ones of the music data codes of said second sort to the certain music data codes of said first sort, and a transmitting means for transferring said music data codes of said first sort to said first sound source in such a manner that the first tones corresponding to said certain music data codes are produced concurrently with the second tones corresponding to said at least selected ones.

19. The ensemble system as set forth in claim 18, in which said first pieces of timing data information define time intervals each between two events successively to occur in the production of said plurality of first tones, and said second pieces of timing data information define lapses of time from a reference time to second tones to be produced on the basis of pieces of music data information stored in said music data codes of said second sort.

20. The ensemble system as set forth in claim 19, in which said music passage includes a certain second tone at the head of a movement or musical composition, and said certain second tone starts at said reference time.

21. The ensemble system as set forth in claim 19, in which said music data codes of said first sort are formatted in accordance with standards of MIDI (Musical Interface Digital Interface), and said music data codes of said second sort are formatted in accordance with standards for CD-DA (Compact Disc Digital Audio).

22. The ensemble system as set forth in claim 19, in which said mapping means creates a table defining relations between the events to occur and said third times and between said third times and locations at which the music data codes of said second sort representative of the pieces of music data information defining said second tones are stored.

23. The ensemble system as set forth in claim 18, said music data codes of said first sort are selected from plural sets of music data codes of said first sort by using a bit string representative of contents of an information storage medium for storing said music data codes of said first sort.

24. The ensemble system as set forth in claim 23, in which said information storage medium is a music compact disc.

25. The ensemble system as set forth in claim 24, in which said music compact disc stores a table of contents, and said bit string represents said table of contents.

26. The ensemble system as set forth in claim 23, in which said bit string is representative of the second tones in a head portion of said music passage.

27. The ensemble system as set forth in claim 23, said data synchronizer further comprises a searching means searching said memory for a bit string identical with said bit string so as to select said music data codes of said first sort from said plural sets of music data codes.

28. The ensemble system as set forth in claim 23, said data synchronizer further comprises a communicating means sending said bit string to a server and receiving said music data codes of said first sort from said server through a communication line.

29. The ensemble system as set forth in claim 18, in which said first sound source and said second sound source are an automatic player piano equipped with a data interface connected to said data synchronizer and a sound reproducer including a compact disc player connected to said data synchronizer.

30. The ensemble system as set forth in claim 18, in which said data synchronizer is communicable through a communication line with a server, and said server has a searching means searching another memory for a bit string identical with said bit string so as to send said music data codes of said first sort selected from said plural sets of music data codes stored in said another memory.

31. The ensemble system as set forth in claim 30, in which said server forms a part of a network together with other servers so that said data synchronizer selectively communicates said servers.

* * * * *